US006729709B2

(12) United States Patent
Konno et al.

(10) Patent No.: US 6,729,709 B2
(45) Date of Patent: May 4, 2004

(54) INK-JET PRINTING METHOD AND APPARATUS

(75) Inventors: Yuji Konno, Kanagawa (JP); Hiroshi Tajika, Kanagawa (JP); Miyuki Fujita, Tokyo (JP); Norihiro Kawatoko, Kanagawa (JP); Takayuki Ogasahara, Kanagawa (JP); Tetsuya Edamura, Kanagawa (JP); Tetsuhiro Maeda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 2 days.

(21) Appl. No.: 09/906,684

(22) Filed: Jul. 18, 2001

(65) Prior Publication Data

US 2002/0018087 A1 Feb. 14, 2002

(30) Foreign Application Priority Data

Jul. 19, 2000 (JP) ..... 2000-219569

(51) Int. Cl.[7] ..... B41J 29/38
(52) U.S. Cl. ..... 347/14; 347/19; 347/17
(58) Field of Search ..... 347/14, 16, 19, 347/17, 10, 11

(56) References Cited

U.S. PATENT DOCUMENTS

| | | | | |
|---|---|---|---|---|
| 4,313,124 A | | 1/1982 | Hara | 346/140 |
| 4,345,262 A | | 8/1982 | Shirato et al. | 346/140 |
| 4,459,600 A | | 7/1984 | Sato et al. | 346/140 |
| 4,463,359 A | | 7/1984 | Ayata et al. | 346/1.1 |
| 4,558,333 A | | 12/1985 | Sugitani et al. | 346/140 |
| 4,723,129 A | | 2/1988 | Endo et al. | 346/1.1 |
| 4,740,796 A | | 4/1988 | Endo et al. | 346/1.1 |
| 5,172,142 A | * | 12/1992 | Watanabe et al. | 346/140 |
| 5,610,638 A | * | 3/1997 | Courtney | 347/14 |
| 5,736,994 A | * | 4/1998 | Takahashi | 347/11 |
| 5,880,751 A | | 3/1999 | Nishikori et al. | 347/14 |
| 5,894,314 A | | 4/1999 | Tajika et al. | 347/14 |

FOREIGN PATENT DOCUMENTS

| | | |
|---|---|---|
| JP | 54-161935 | 12/1979 |
| JP | 60-210480 | 10/1985 |
| JP | 61-185455 | 8/1986 |
| JP | 61-249768 | 11/1986 |
| JP | 1-308647 | 12/1989 |
| JP | 4-10941 | 1/1992 |

* cited by examiner

*Primary Examiner*—Hai Pham
*Assistant Examiner*—Lam Nguyen
(74) *Attorney, Agent, or Firm*—Fitzpatrick, Cella, Harper & Scinto

(57) ABSTRACT

An ink-jet printing apparatus, for printing an image based on image information on a printing medium by relatively moving an ink-jet printhead, detects the temperature of the ink-jet printhead by using a head temperature detection unit and outputs it to a driving frequency determination unit. The driving frequency determination unit acquires temperature information in units of pages of image information or predetermined image areas. If the acquired temperature is equal to or higher than a predetermined temperature, the driving frequency of the ink-jet printhead is decreased when a predetermined unit of the image information is printed.

17 Claims, 24 Drawing Sheets

CONNECT APPARATUS TO POWER SUPPLY
FIRST INITIALIZATION
S1
1
S2
NO
POWER KEY ON ?
YES
SECOND INITIALIZATION
S3
2
S4
WAIT FOR EVENT?
PRINT COMMAND RECEPTION
POWER KEY OFF INPUT
ANOTHER EVENT INPUT
S10
S11
S5
COMMAND ANALYSIS
PRINTER TERMINATION PROCESS
EVENT PROCESSING
S6
PAPER FEED
1
2
S7
ONE PAGE PRINT
S8
DISCHARGE PAPER
S9
NO
ARE ALL PAGES PRINTED?
YES
2

FIG. 13

| HEAD TEMPERATURE (℃) | ~5 | 5~20 | 20~25 | 25~30 | 30~35 | 35~40 | 40~45 | 45~50 | 50~55 | 55~60 | 60~90 | 90~ |
|---|---|---|---|---|---|---|---|---|---|---|---|---|
| DIGITAL TEMPERATURE INFORMATION | 1 | 2 | 3 | 4 | 5 | 6 | 7 | 8 | 9 | 10 | 11 | 12 |

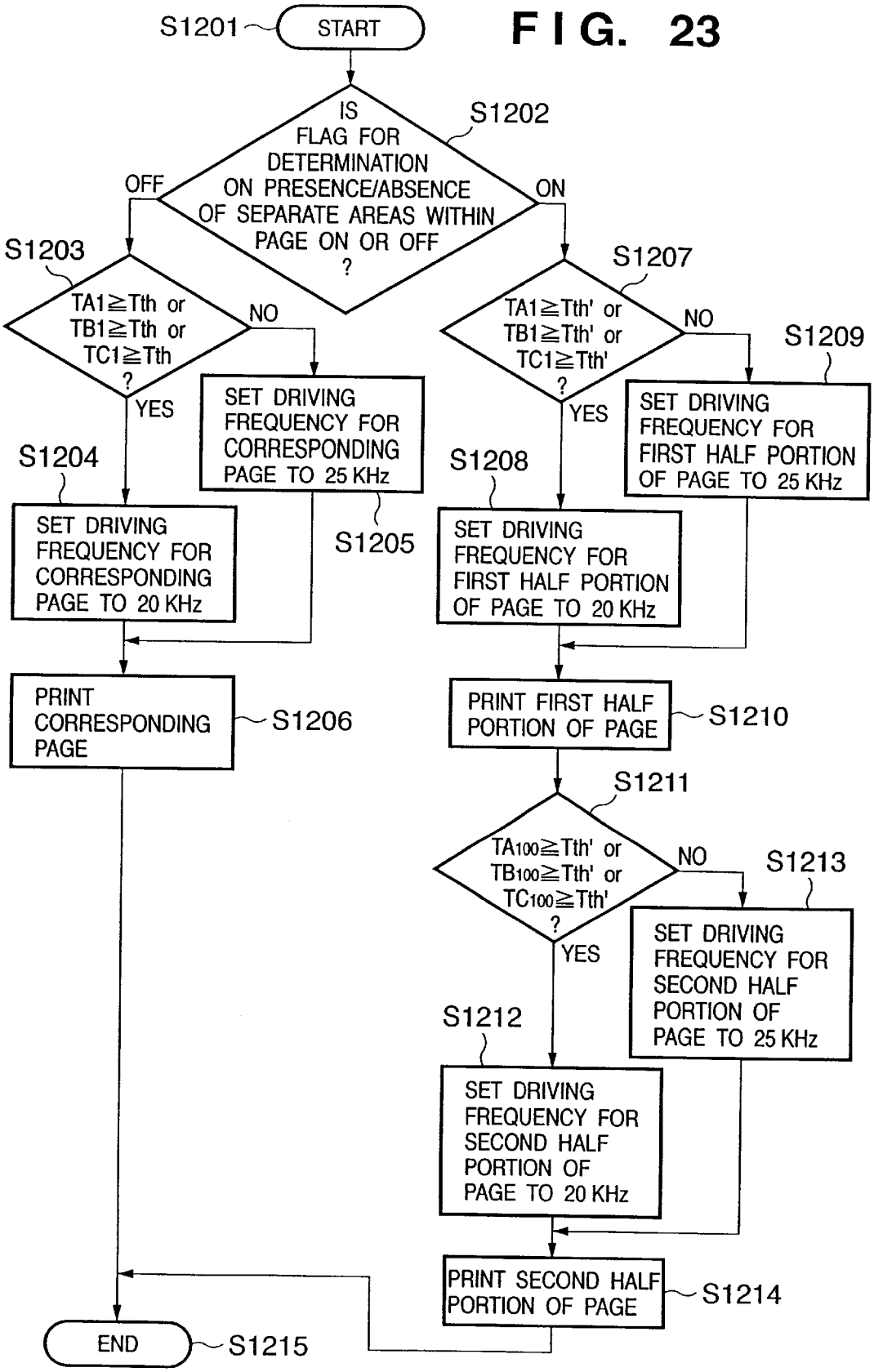
S1201
START
FIG. 23
S1202
IS FLAG FOR DETERMINATION ON PRESENCE/ABSENCE OF SEPARATE AREAS WITHIN PAGE ON OR OFF ?
OFF
ON
S1203
TA1≧Tth or TB1≧Tth or TC1≧Tth ?
NO
YES
SET DRIVING FREQUENCY FOR CORRESPONDING PAGE TO 25 KHz
S1205
S1204
SET DRIVING FREQUENCY FOR CORRESPONDING PAGE TO 20 KHz
PRINT CORRESPONDING PAGE
S1206
S1207
TA1≧Tth' or TB1≧Tth' or TC1≧Tth' ?
NO
YES
S1209
SET DRIVING FREQUENCY FOR FIRST HALF PORTION OF PAGE TO 25 KHz
S1208
SET DRIVING FREQUENCY FOR FIRST HALF PORTION OF PAGE TO 20 KHz
PRINT FIRST HALF PORTION OF PAGE
S1210
S1211
TA100≧Tth' or TB100≧Tth' or TC100≧Tth' ?
NO
YES
S1213
SET DRIVING FREQUENCY FOR SECOND HALF PORTION OF PAGE TO 25 KHz
S1212
SET DRIVING FREQUENCY FOR SECOND HALF PORTION OF PAGE TO 20 KHz
PRINT SECOND HALF PORTION OF PAGE
S1214
END
S1215

INK-JET PRINTING METHOD AND APPARATUS

FIELD OF THE INVENTION

The present invention relates to an ink-jet printing method and apparatus which print an image based on image information on a printing medium by moving relatively each ink-jet printhead and the printing medium. Note that the present invention can be applied to copying machines, facsimile apparatuses having communication systems, wordprocessors and the like having printing units, and industrial printing apparatuses combined with various processing apparatuses as well as general printing apparatuses.

BACKGROUND OF THE INVENTION

In an ink-jet printing apparatus having a serial type of ink-jet head, the ink-jet head is driven to discharge ink from each nozzle in synchronism with the scanning operation of the ink-jet head on the basis of a head driving signal to scan the ink-jet head in the main scanning direction, thereby forming an image on a printing medium such as a printing sheet.

A printhead used for an ink-jet printing apparatus will be described next.

Ink-jet printing schemes typically include a scheme using an electrothermal transducer (heater) as an element for generating discharge energy to eject ink droplets or a scheme using a piezoelectric element. In both schemes, ink is ejected by supplying an electrical signal to an element for generating discharge energy. An advantage of the former scheme is that only a small space is required to place each heater serving as an element for generating discharge energy. This makes it possible to simplify the arrangement of an ink-jet printhead and hence reduce its size. In addition, it is relatively easy to achieve an increase in density. A disadvantage of this scheme is that the heat generated by each heater is accumulated in the printhead. As a consequence, ejected ink droplets tend to vary in volume. In addition, shock (cavitation) produced when air bubbles generated to eject ink shrink and disappear greatly affect the heaters.

As methods of solving these problems, for example, ink-jet printing methods are disclosed in Japanese Patent Laid-Open Nos. 54-161935, 61-185455, 61-249768, and 4-10941. According to these methods, each ink-jet head has an orifice for discharging a liquid, an ink channel which communicates with the orifice and is filled with ink, and an electrothermal transducer placed in the ink channel. This electrothermal transducer is generally formed by a thin resistive element. According to a characteristic feature of this electrothermal transducer, a pulse-like current is supplied (application of a driving pulse) to the electrothermal transducer through an interconnection to generate heat energy. By using such a printing method, the stability of the volume of each ink droplet can be improved, and small droplets can be ejected at high speed. This makes it possible to improve the durability of each heater by solving the problem of cavitations produced by printing and defoaming.

When, however, images are continuously printed by using such a conventional ink-jet head with a high duty, the temperature of the head rises. With this rise in temperature, the bubble size increases due to the driving operation for ejecting ink droplets, and the ink refill operation becomes insufficient for the next ink ejecting operation, resulting in a deterioration in the driving frequency characteristics of the head. If the printhead is driven to eject ink before the printhead is sufficiently refilled with ink, ejected ink droplets vary in amount. As a consequence, ink droplets land disorderly, and hence the image quality greatly deteriorates.

If the driving frequency of each head in printing operation using an ink-jet printing apparatus is uniformly set to be low in consideration of a deterioration in the driving frequency characteristics of the printhead which is caused by a rise in the temperature of the head, the overall throughput decreases.

A method of detecting the temperature of each printhead and controlling the driving frequency of the printhead in accordance with the detected temperature is disclosed in Japanese Patent Laid-Open No. 1-308647. In this case, the scanning speed of the printhead is decreased and the driving frequency is decreased immediately after the temperature of the printhead exceeds a predetermined temperature. For this reason, when the scanning speed of the printhead has been changed, a deterioration in image, e.g., density unevenness and streaks, occurs.

An ink-jet printing apparatus and a control method for the apparatus which switches the head driving frequencies in accordance with the environmental temperature are disclosed in Japanese Patent Laid-Open No. 60-210480. This head driving frequency switching is performed on the basis of the environmental temperature obtained by a temperature detector mounted outside each printhead. The internal temperature of each ink-jet head locally rises greatly when, for example, the head is continuously driven to eject ink. It is therefore difficult to satisfactorily cope with a change in temperature by head driving control based on only the environmental temperature outside the printhead. In addition, in general, the environmental temperature does not abruptly change within a short period of time. However, the head temperature abruptly changes when several pages are continuously printed. Therefore, the timing at which a head temperature is detected and the timing at which the driving frequency is controlled are important. According to Japanese Patent Laid-Open No. 60-210480, the driving frequencies are controlled on the basis of only the environmental temperature. With regard to this control, therefore, this reference discloses only a technique of simply switching driving frequencies of the printhead depending on whether the environmental temperature is higher or lower than a reference temperature.

SUMMARY OF THE INVENTION

The present invention has been made in consideration of the prior arts described above, and has as its object to provide an ink-jet printing method and apparatus which can prevent a deterioration in image due to a deterioration in ink refill characteristics with a rise in temperature inside an ink-jet printhead and minimize a decrease in printing speed.

It is another object of the present invention to provide an ink-jet printing method and apparatus which can prevent a deterioration in image by suppressing a rise in the temperature of an ink-jet printhead.

In order to attain the objects, the present invention of an ink-jet printing apparatus comprises the structure as follows.

An ink-jet printing apparatus for printing an image based on image information on a printing medium by relatively moving an ink-jet printhead and the printing medium, comprises: temperature detection means for detecting a temperature of the ink-jet printhead and outputting temperature information; acquisition means for acquiring the temperature information detected by said temperature detection means; and control means for performing control to switch driving frequencies of the ink-jet printhead in units in which the image information does not continue in accordance with a comparison result on the temperature information acquired by said acquisition means and a predetermined temperature.

In order to attain the objects, the present invention of an ink-jet printing method comprises the steps as follows.

An ink-jet printing method for an ink-jet printing apparatus for printing an image based on image information on a printing medium by relatively moving an ink-jet printhead and the printing medium, comprising the steps of: acquiring a temperature of the ink-jet printhead; and controlling to switch driving frequencies of the ink-jet printhead in units in which the image information does not continue in accordance with a comparison result on the temperature information acquired in said acquiring step and a predetermined temperature.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the descriptions, serve to explain the principle of the invention.

FIG. 13 is a view showing the relationship between the digital temperature information output from a head temperature detection unit and the actual temperature of a printhead according to this embodiment;

FIG. 23 is a flow chart for explaining driving frequency determination processing in the driving frequency determination unit of the ink-jet printer according to the second embodiment of the present invention.

DETAILED DESCRIPTION OF THE PREFERRED EMBODIMENTS

The preferred embodiments of the present invention will be described in detail below with reference to the accompanying drawings.

[First Embodiment]

In the embodiment described below, an ink-jet printer will be described as an example of a printer using the ink-jet printing scheme.

In this specification, the word "print" broadly includes operation of forming images, figures, patterns, and the like on printing media or performing processes on media, as well as operation of forming significant information such as characters and graphic patterns, regardless of whether they are significant or insignificant and visualized to be visually perceived.

In this case, the word "printing medium" broadly includes materials that can receive ink, e.g., cloth, plastic film, metal plate, glass, ceramics, wood, and leather as well as paper that is used in general printers.

In addition, the word "ink" should be broadly interpreted like the above word "print", and indicates liquids that can be used for the formation of images, figures, patterns, and the like, processes on printing media, and processes for ink (e.g., solidification or insolubilization of coloring materials in ink applied onto printing media).

[Main Body of Apparatus]

Figure 1:
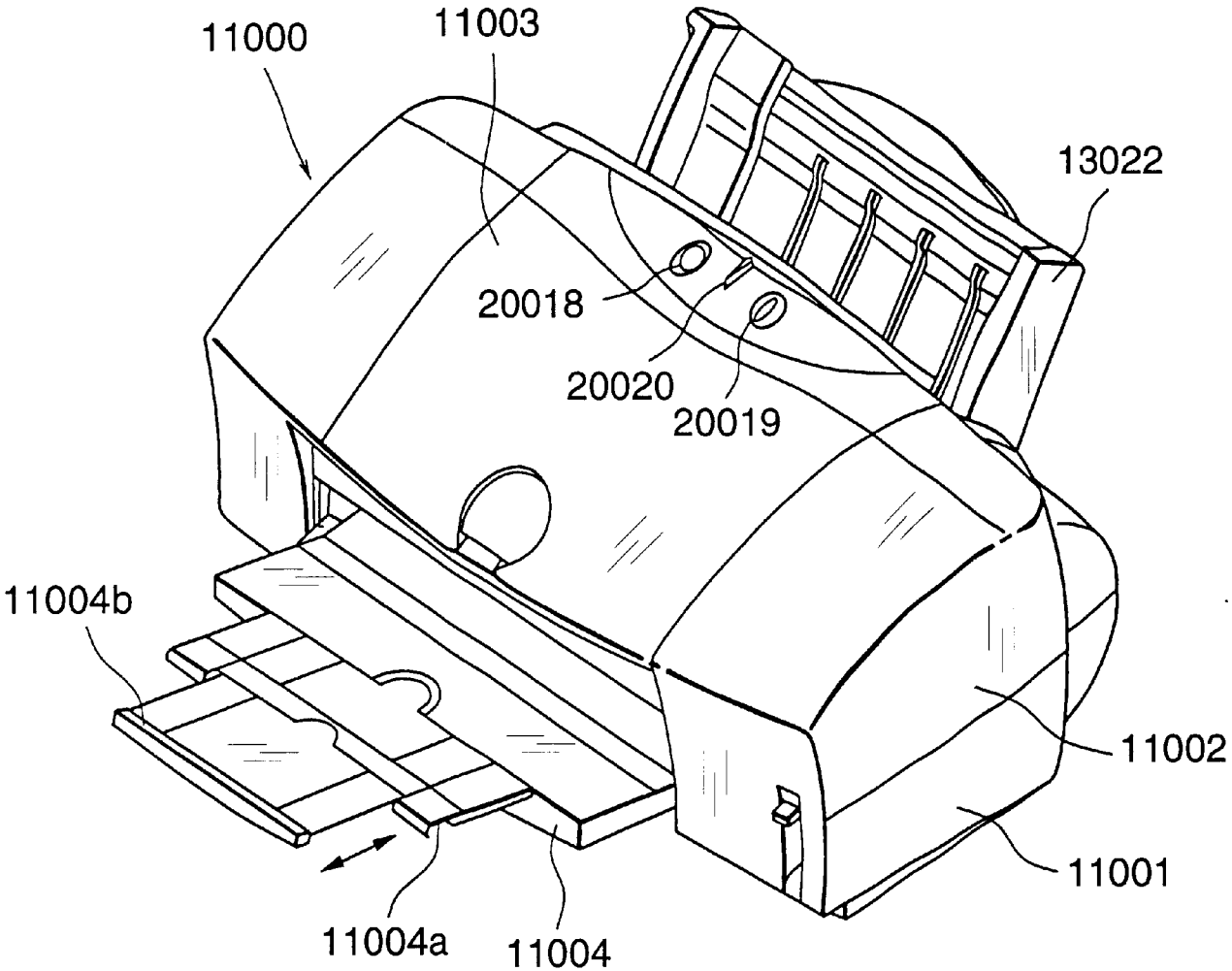
FIG. 1 is a perspective view showing the outer arrangement of an ink-jet printer according to an embodiment of the present invention.
Figure 2:
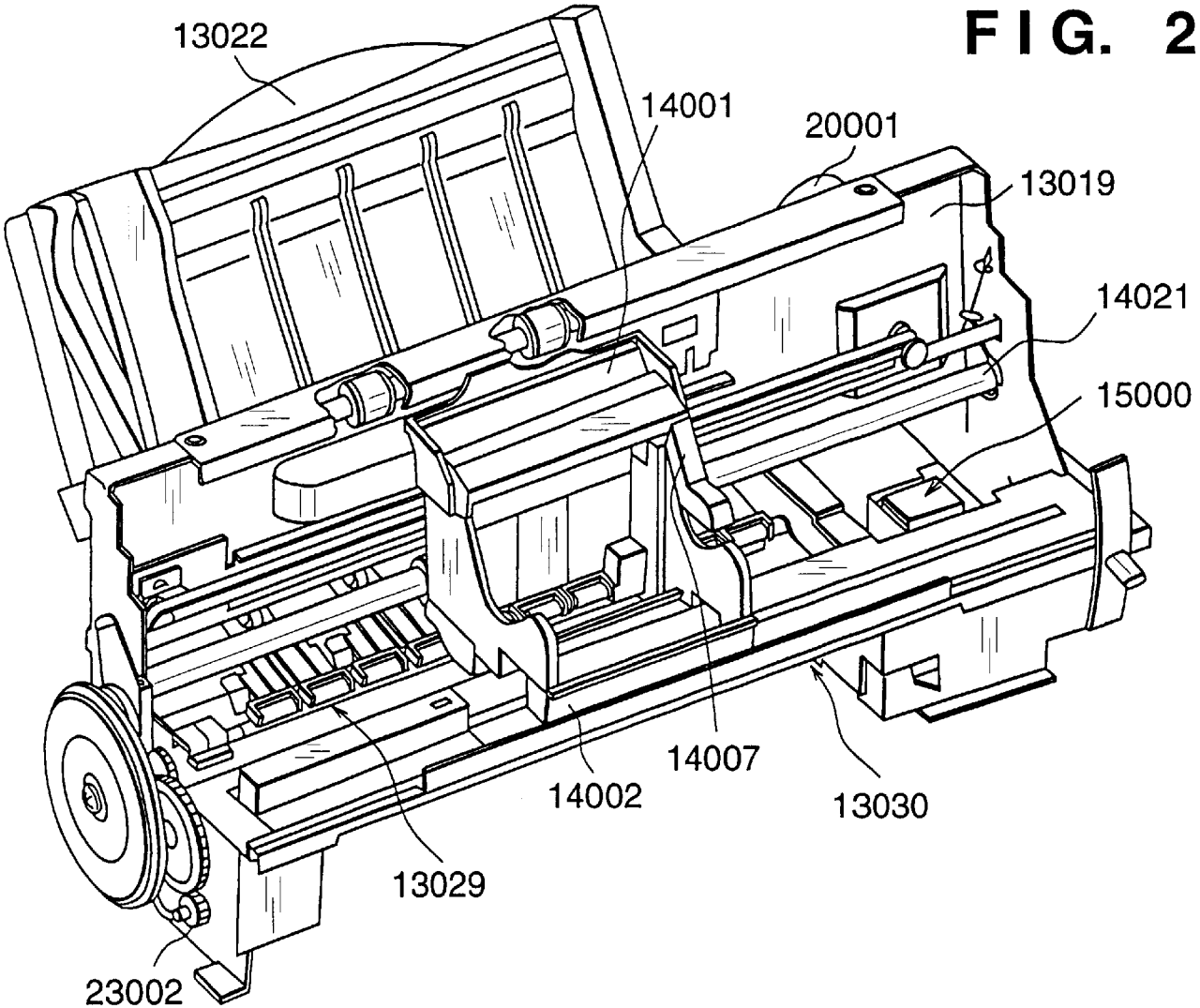
FIG. 2 is a perspective view showing a state where the casing members of the ink-jet printer shown in FIG. 1 according to this embodiment have been removed.

FIGS. 1 and 2 show the schematic arrangement of an ink-jet printer using the ink-jet printing scheme. Referring to FIG. 1, a main body 11000, which is the framework of the printer according to this embodiment, includes a lower case 11001, upper case 11002, access cover 11003, and discharge tray 11004 serving as casing members, and a chassis 13019 (see FIG. 2) housed in the casing members. The chassis

13019 is made up of a plurality of plate-like metal members each having predetermined rigidity, forms the frame of this printer, and holds the respective printing mechanisms to be described later.

The lower case 11001 forms substantially the lower half portion of the main body 11000, and the upper case 11002 forms substantially the upper half portion of the main body 11000. These two cases are assembled into a hollow structure incorporating a housing space for housing the respective mechanisms to be described later. Opening portions are formed in the upper surface portion and front surface portion of this structure.

The discharge tray 11004 has one end portion rotatably held in the lower case 11001. The opening portion formed in the front surface portion of the lower case 11001 is opened/closed by rotating the discharge tray 11004. To print, the discharge tray 11004 is rotated toward the front surface side to open the opening portion to allow a printed sheet to be discharged therefrom and also allow discharged printing sheets to be sequentially stacked. Two auxiliary trays 11004*a* and 11004*b* are housed in the discharge tray 11004. Each tray is pulled forward, as needed, to increase/decrease the printing sheet support area in three levels.

The access cover 11003 has one end portion rotatably held in the upper case 11002 and can open/close the opening portion formed in the upper surface. When this access cover 11003 is opened, a printhead cartridge 31000 (FIG. 3), ink tank 31900 (FIG. 4), or the like housed in the main body can be replaced. Although not shown here, when the access cover 11003 is opened/closed, a projection formed on its lower surface rotates a cover opening/closing lever. The opened/closed state of the access cover 11003 can be detected by detecting the rotational position of the lever using a microswitch or the like.

Figure 7:
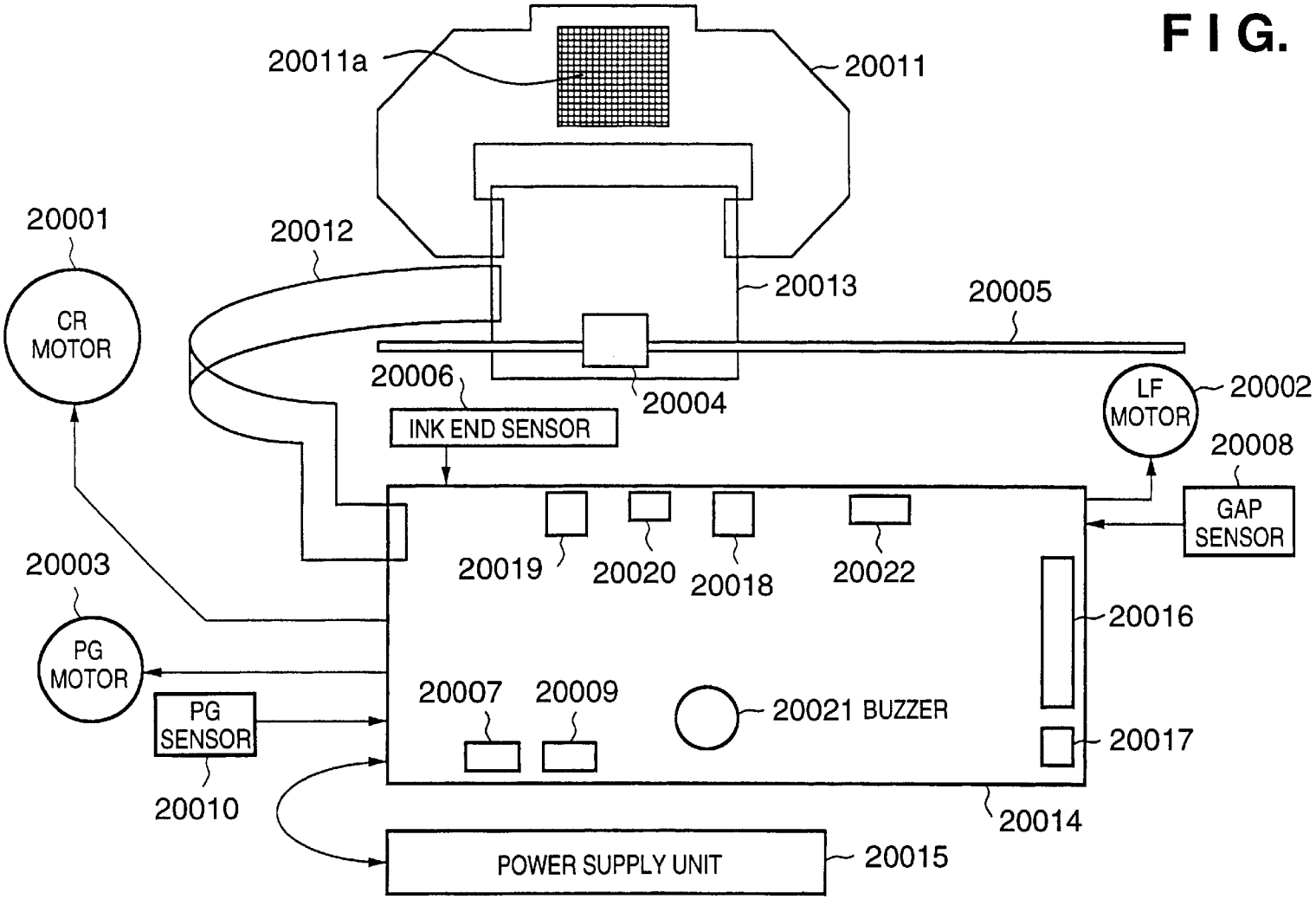
FIG. 7 is a block diagram schematically showing the overall arrangement of an electrical circuit in the ink-jet printer according to this embodiment.

A power key 20018 and resume key 20019 are so arranged on the upper surface of the rear portion of the upper case 11002 to allow an operator to press them, together with an LED 20020. When the power key 20018 is pressed, the LED 20020 is turned on to inform the operator that printing can be performed. In addition, the LED 20020 has various indicating functions of informing the operator of troubles and the like in the ink-jet printer by changing the manner of blinking or color or sounding a buzzer 20021 (FIG. 7). Note that when a trouble or the like is solved, the printing operation can be resumed by pressing the resume key 20019.

[Printing Mechanism]

A printing mechanism according to this embodiment which is housed and held in the main body 11000 of the ink-jet printer will be described next with reference to FIG. 2.

The printing mechanism according to this embodiment includes an automatic feeding unit 13022 (FIG. 1) for automatically feeding a printing sheet into the main body, a convey unit 13029 for guiding printing sheets fed one by one from the automatic feeding unit 13022 to a desired printing position and also guiding the printing sheet from the printing position to a discharge unit 13030, a printing unit for performing desired printing operation on the printing sheet conveyed by the convey unit 13029, and a recovering unit 15000 for performing recovery processing for this printing unit and the like.

(Printing Unit)

The printing unit will be described below.

This printing unit includes a carriage 14001 movably supported on a carriage shaft 14021, and the printhead cartridge 31000 (FIG. 3) detachably mounted on the carriage 14001.

[Printhead Cartridge]

Figure 3:
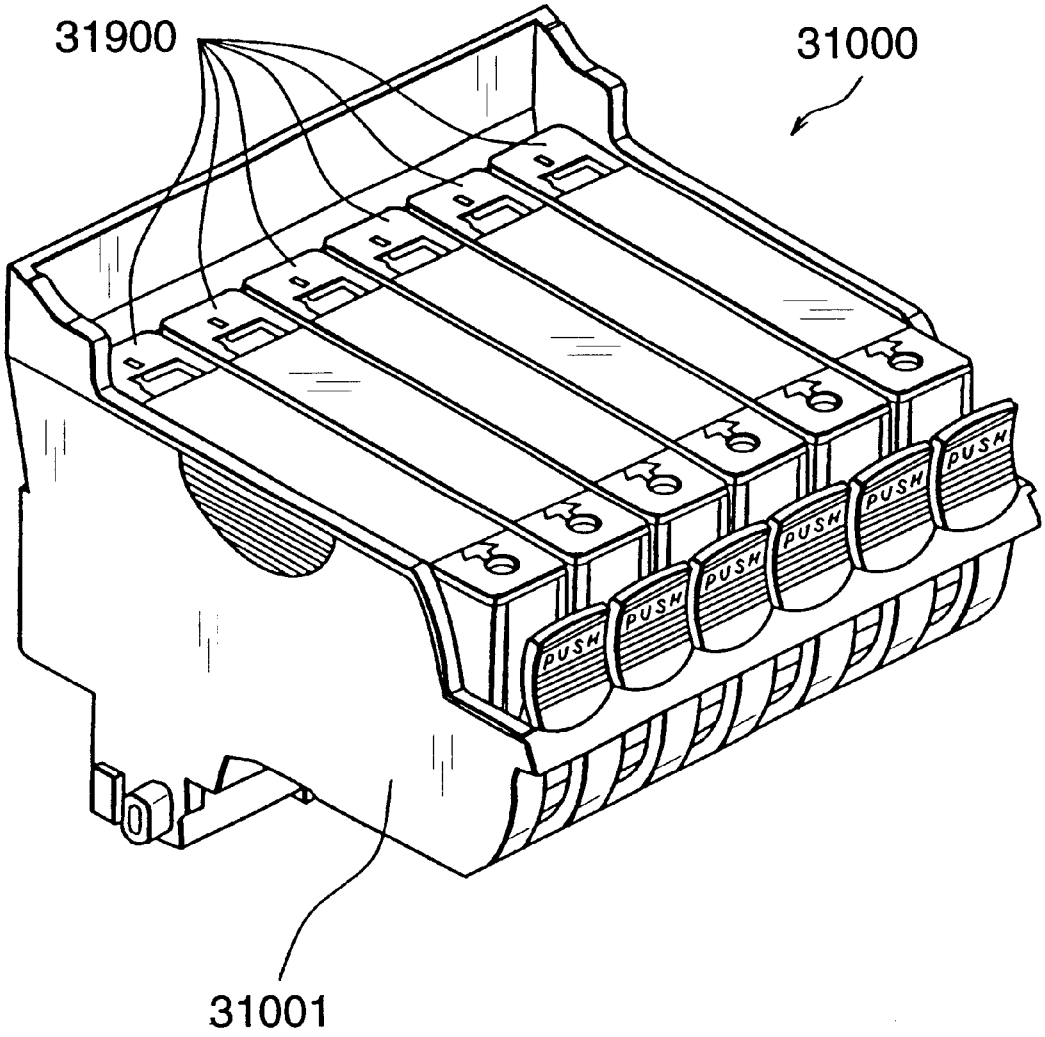
FIG. 3 is a perspective view showing the printhead cartridge of the ink-jet printer according to this embodiment.

The printhead cartridge 31000 will be described first with reference to FIGS. 3 to 5.

The printhead cartridge 31000 according to this embodiment has the ink tank 31900 storing ink and a printhead 31001 for discharging ink, supplied from the ink tank 31900, from nozzles in accordance with print information. This printhead 31001 is detachably mounted in the carriage 14001 (FIG. 2) to be described later, that is, adopts a so-called cartridge scheme.

In this printhead cartridge 31000, ink tanks are separately prepared for black (K), light cyan (LC), light magenta (LM), cyan (C), magenta (M), and yellow (Y) inks to print photo-quality, high-quality color images. As shown in FIG. 4, each ink tank is detachably mounted on the printhead 31001.

Figure 5:
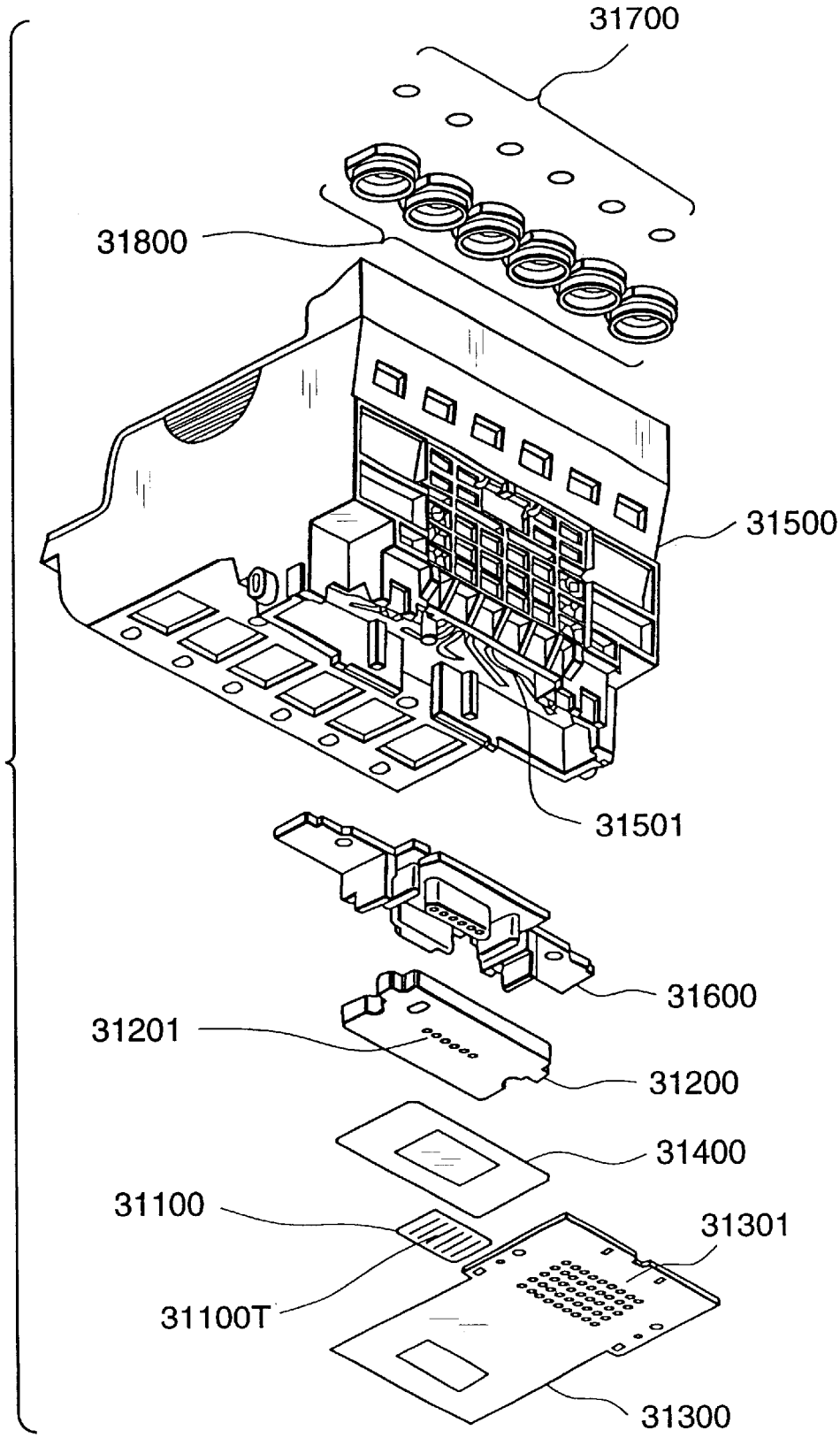
FIG. 5 is an exploded perspective view showing the printhead in FIG. 4 when viewed from obliquely below.

As shown in the exploded perspective view of FIG. 5, the printhead 31001 includes a print element board 31100, first plate 31200, electric wiring board 31300, second plate 31400, tank holder 31500, ink channel forming member 31600, filter 31700, and seal rubbers 31800.

A plurality of print elements for ejecting ink are formed on one surface of the Si board as the print element board 31100, together with Al (Aluminum) interconnections or the like for supplying power to each print element, which are formed by a film forming technique. In addition, a plurality of ink channels and orifices 31100T corresponding to these print elements are formed in the print element board 31100 by photolithography. Furthermore, ink supply ports for supplying ink to the ink channels are formed in the lower surface of the print element board 31100. The print element board 31100 is bonded/fixed to the first plate 31200, in which ink supply ports 31201 for supplying ink to the print element board 31100 are formed. The second plate 31400 having an opening portion is bonded/fixed to the first plate 31200. The second plate 31400 holds the electric wiring board 31300 such that the electric wiring board 31300 is electrically connected to the print element board 31100.

The electric wiring board 31300 serves to apply, to the print element board 31100, electrical signals for discharging ink, and has interconnections corresponding to the print element board 31100 and external signal input terminals 31301 which are located at end portions of the interconnections and receive electrical signals from the main body. These external signal input terminals 31301 are positioned/fixed on the rear surface side of the tank holder 31500 to be described later.

Figure 4:
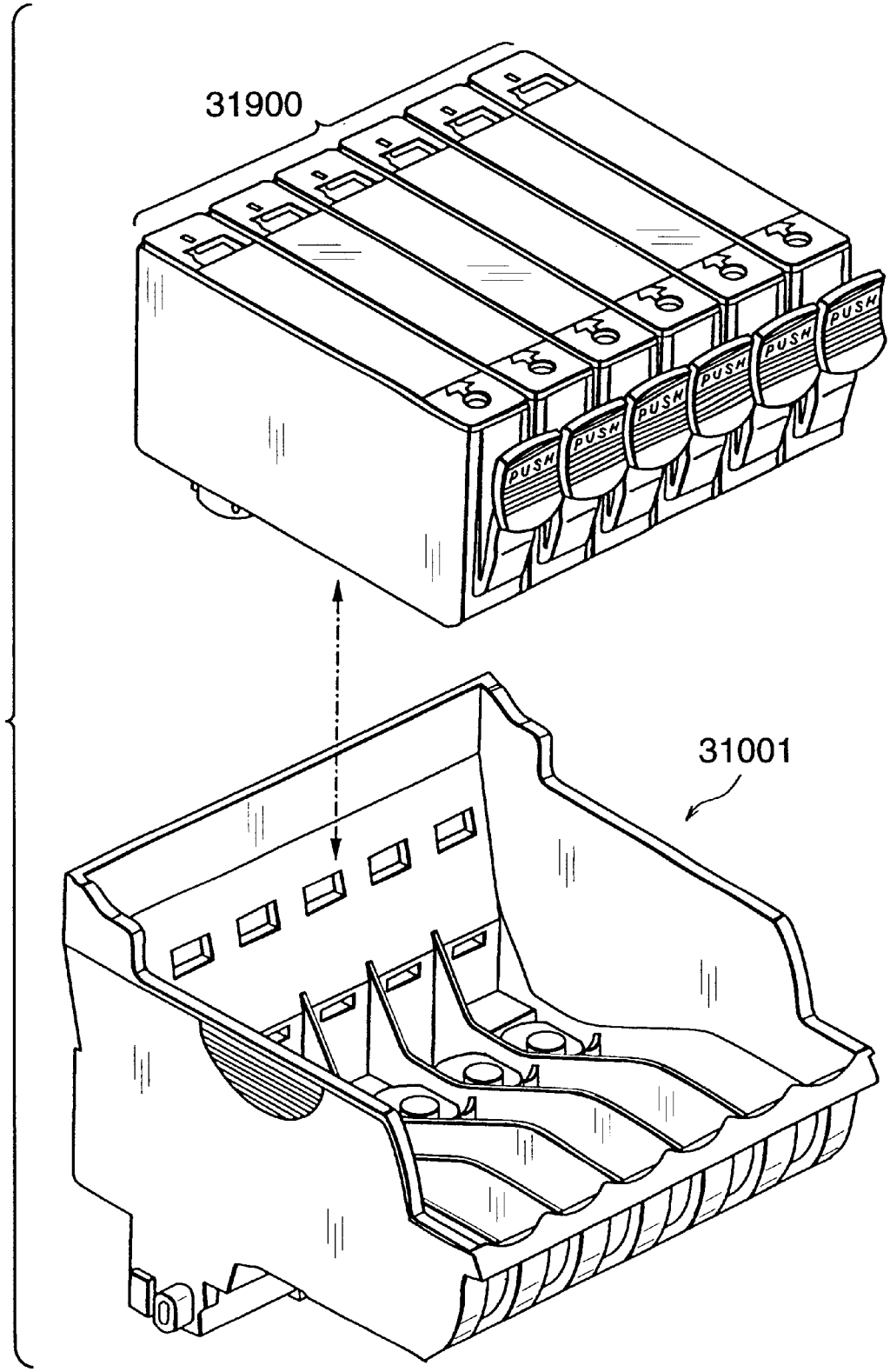
FIG. 4 is an exploded perspective view showing the printhead cartridge of the ink-jet printer according to this embodiment.

The ink channel forming member 31600 is ultrasonically welded to the tank holder 31500 for detachably holding the ink tank 31900 in FIG. 4, to form ink channels 31501 extending from the ink tank 31900 to the first plate 31200. The filter 31700 is placed at the ink-tank-side end portions of the ink channels 31501 which are engaged with the ink tank 31900 to prevent the entrance of external dust. The seal rubbers 31800 are attached to the portions engaged with the ink tank 31900 to prevent evaporation of ink from the engaging portions.

The tank holder unit constituted by the tank holder 31500, ink channel forming member 31600, filter 31700, and seal rubbers 31800 is coupled to the print element unit constituted by the print element board 31100, first plate 31200, electric wiring board 31300, and second plate 31400 with an adhesive or the like, thus forming the printhead 31001.

[Carriage]

The carriage 14001 will be described next with reference to FIGS. 2 and 7.

As shown in FIG. 2, the carriage 14001 includes a carriage cover 14002 (FIG. 2) which is engaged with the carriage 14001 and serves to guide the printhead 31001 to the mount position on the carriage 14001 and a head set lever 14007 (FIG. 2) which is engaged with the tank holder 31500 of the printhead 31001 to press the printhead 31001 to set it at a predetermined mount position. That is, the head set lever 14007 is mounted on the upper portion of the carriage 14001 to be pivotal with respect to the head set level shaft, and a head set plate (not shown) is attached to the portion engaged with the printhead 31001 via a spring. With this spring force, the printhead 31001 is pressed and mounted on the carriage 14001.

A contact flexible print cable (to be referred to as a contact FPC hereinafter) 20011 (FIG. 7) is placed at another engaging portion between the carriage 14001 and the printhead 31001 to make a contact portion 20011a on the contact FPC 20011 electrically contact the contact portion (external signal input terminals) 31301 (FIG. 5) on the printhead 31001. This makes it possible to exchange various pieces of information for printing operation and supply power to the printhead 31001.

In this case, an elastic member such as a rubber member (not shown) is inserted between the contact portion 20011*a* of the contact FPC 20011 and the carriage 14001 to ensure contact between the contact portion 20011*a* and the carriage 14001 with the pressing force produced by the elastic force of this elastic member and the spring force of the head set lever 14007. In addition, a carriage board 20013 mounted on the rear surface of the carriage 14001 is connected to the contact FPC 20011 (see FIG. 7).

[Scanner]

The ink-jet printer according to this embodiment can also be used as a reader by replacing the printhead 31001 with a scanner.

This scanner moves together with the carriage 14001 of the ink-jet printer to read an original image, fed in place of a printing medium, in the sub-scanning direction. By alternately performing this reading operation and original feeding operation, original image information corresponding to one sheet can be read.

Figure 6B:
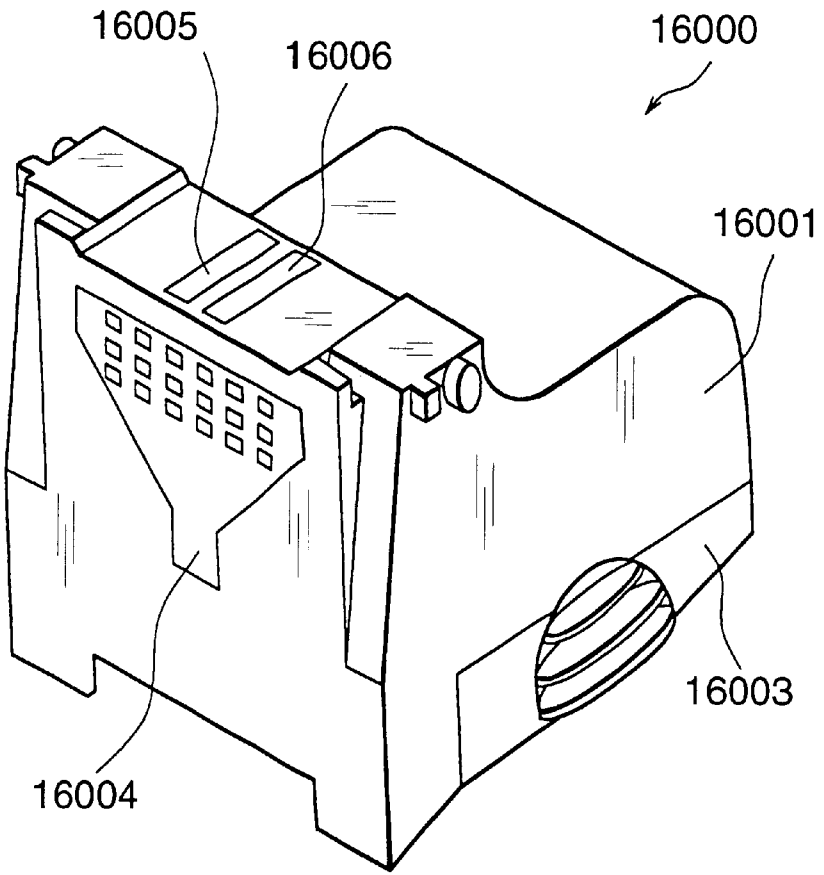
FIGS. 6A and 6B are perspective views showing a scanner cartridge according to this embodiment of the present invention.
Figure 6A:
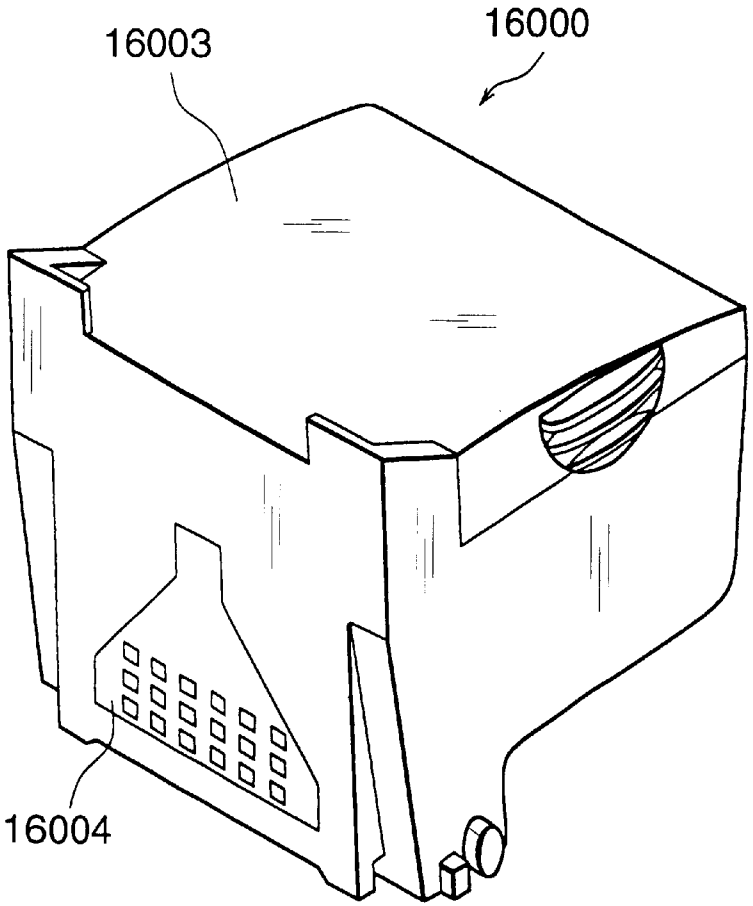

FIGS. 6A and 6B are views showing the schematic arrangement of a scanner 16000.

As shown in FIG. 6A and 6B, a scanner holder 16001 has a box-like shape, in which optical units, processing circuits, and the like required for reading operation are housed. A scanner read lens 16006 is mounted on that portion of this scanner 16000 which faces an original surface when it is mounted on the carriage 14001. An original image is read through this portion. A scanner illumination lens 16005 incorporates a light source (not shown). An original is irradiated with light emitted from this light source.

A scanner cover 16003 fixed to the bottom portion of the scanner holder 16001 is fitted thereon to shield the interior of the scanner holder 16001 against light, and has louvered grip portions formed on its side surfaces to facilitate attachment/detachment to/from the carriage 14001. The outer shape of the scanner holder 16001 is almost the same as that of the printhead cartridge 31000. This allows the scanner holder 16001 to be attached/detached to/from the carriage 14001 by the same operation as that for the printhead cartridge 31000.

A board having the above processing circuits is housed in the scanner holder 16001, and a scanner contact PCB 16004 connected to this board is so mounted in the scanner holder 16001 as to be exposed to the outside. When the scanner 16000 is mounted on the carriage 14001, the scanner contact PCB 16004 comes into contact with the contact FPC 20011 on the carriage 14001 side to electrically connect the board to the control circuit on the main body side through the carriage 14001.

The electric circuit arrangement of the ink-jet printer according to this embodiment of the present invention will be described next.

FIG. 7 is a view schematically showing the overall arrangement of the electric circuit of the ink-jet printer according to this embodiment.

The electric circuit according to this embodiment includes the carriage board (CRPCB) 20013, a main PCB (Printed Circuit Board) 20014, and a power supply unit 20015. In this case, the power supply unit 20015 is connected to the main PCB 20014 to supply various driving powers.

The carriage board 20013 is a printed circuit board unit mounted on the carriage 14001 (FIG. 2) and serves as an interface for exchanging signals with the printhead 31001 through the contact FPC 20011. The carriage board 20013 detects a change in the positional relationship between an encoder scale 20005 and an encoder sensor 20004 on the basis of the pulse signal output from the encoder sensor 20004 upon movement of the carriage 14001, and outputs the corresponding output signal to the main PCB 20014 through a flexible flat cable (CRFFC) 20012.

The main PCB 20014 is a printed circuit board unit for controlling the driving operation of each component of the ink-jet printer according to this embodiment, and has, on a board, I/O ports corresponding to a (paper end sensor) PE sensor 20007, an ASF sensor 20009, a cover sensor 20022, a parallel interface (parallel I/F) 20016, a serial interface (serial I/F) 20017, the resume key 20019, the LED 20020, the power key 20018, the buzzer 20021, and the like. The main PCB 20014 is connected to a CR motor 20001 (FIG. 2), LF motor 20002, and PG motor 20003 to control their driving operations, and has connection interfaces or the like for an ink end sensor 20006, a GAP sensor 20008, a PG sensor 20010, the CRFFC 20012, and the power supply unit 20015.

Figure 8:
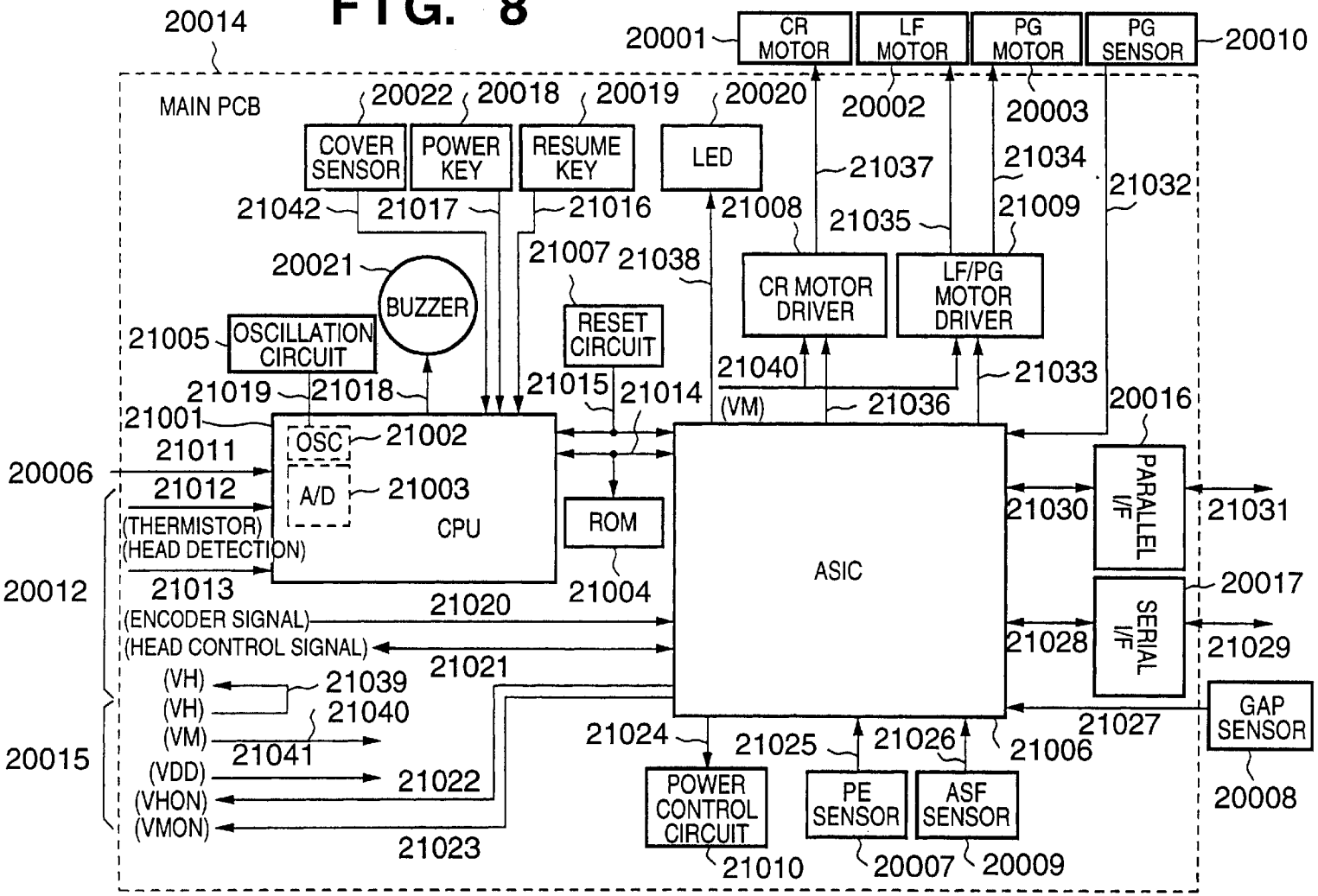
FIG. 8 is a block diagram showing the internal arrangement of a main PCB in FIG. 7.

FIG. 8 is a block diagram showing the internal arrangement of the main PCB 20014.

Referring to FIG. 8, reference numeral 21001 denotes a CPU, which incorporates an oscillator OSC 21002 and is connected to an oscillation circuit 21005 to generate a system clock by using an output clock signal 21019 from the oscillation circuit 21005. In addition, the CPU 21001 is connected to a ROM 21004 and ASIC (Application Specific Integrated Circuit) 21006 through a control bus 21014. In accordance with the programs stored in the ROM 21004, the CPU 21001 controls the ASIC 21006, detects the states of the input signal 21017 from the power key 20018 (FIG. 7), an input signal from the resume key 20019, a cover detection signal, and a head detection signal (HSENS) 21013, drives a buzzer 20021 in accordance with a buzzer signal (BUZ) 21018, and detects an amount of ink and a head temperature based on the output of A/D converter 21012 to which an ink end detection signal (INKS) 21011 and a temperature detection signal (TH) 21012 are supplied, while performing various logic operations, conditional determination, and the like, thereby controlling the driving operation of this ink-jet printer.

In this case, a head detection signal 21013 is a detection signal for detecting whether a printhead is mounted, which is input from the printhead cartridge 31000 through the flexible flat cable 20012 and contact flexible flat cable 20011 (FIG. 7). The ink end detection signal 21011 is an analog signal output from the ink end sensor 20006. The temperature detection signal 21012 is an analog signal from a thermistor (not shown) mounted on the carriage board 20013 (FIG. 7).

Reference numeral 21008 denotes a CR motor driver for driving the CR motor 20001 by generating a CR motor driving signal 21037 in accordance with a CR motor control signal 21036 from the ASIC 21006 using a motor power supply (VM) 21040 as a driving source; and numeral 21009 denotes an LF/PG motor driver for driving the LF motor 20002 by generating an LF motor driving signal 21035 in accordance with a pulse motor control signal (PM control signal) 21033 from the ASIC 21006 using the motor power supply 21040 as a driving source, and also driving the PG motor 20003 by generating a PG motor driving signal 21034.

Reference numeral 21010 denotes a power control circuit for controlling the supply of power to each sensor or the like having a light-emitting element in accordance with a power control signal 21024 from the ASIC 21006. A parallel I/F 20016 transfers a parallel I/F signal 21030 from the ASIC 21006 to a parallel I/F cable 21031 connected to an external unit, and also transfers a signal from the parallel I/F cable 21031 to the ASIC 21006. A serial I/F 20017 transfers a serial I/F signal 21028 from the ASIC 21006 to a serial I/F cable 21029 connected to an external unit, and also transfers a signal from the serial I/F cable 21029 to the ASIC 21006.

The power supply unit 20015 supplies head power supply voltage (VH) 21039, the motor power supply voltage (VM) 21040, and logic power supply voltage (VDD) 21041. A head power ON signal (VHON) 21022 and motor power ON signal (VMOM) 21023 from the ASIC 21006 are input to the power supply unit 20015 to ON/OFF-control the head power supply (VH) voltage and motor power supply voltage 21040, respectively. The logic power supply voltage (VDD) 21041 supplied from the power supply unit 20015 is subjected to voltage conversion as needed, and then supplied to the respective components inside/outside the main PCB 20014.

The head power supply voltage 21039 is smoothed on the main PCB 20014, and then sent to the flexible flat cable 20011 to be used to drive the printhead cartridge 31000.

Reference numeral 21007 denotes a reset circuit for detecting a drop in the logic power supply voltage 21041, and supplies a reset signal (RESET) 21015 to the CPU 21001 and ASIC 21006 to perform initialization.

This ASIC 21006 is a 1-chip semiconductor integrated circuit controlled by the CPU 21001 through the control bus 21014 to output the above CR motor control signal 21036, pulse motor control signal 21033, power control signal 21024, head power ON signal 21022, motor power ON signal 21023, and the like and exchange signals with the parallel I/F 20016 and serial I/F 20017. In addition, the ASIC 21006 detects the states of a PE detection signal (PES) 21025 from the PE sensor 20007, an ASF detection signal (ASFS) 21026 from the ASF sensor 20009, a GAP detection signal (GAPS) 21027 from the GAP sensor 20008, and a PG detection signal (PGS) 21032 from the PG sensor 20010, and transfers data representing the detected states to the CPU 21001 through the control bus 21014. With this operation, the CPU 21001 controls the driving operation of an LED driving signal 21038 to blink an LED 20020 on the basis of the input data.

In addition, the ASIC 21006 detects the state of an encoder signal (ENC) 21020 to generate a timing signal, and interfaces with the printhead cartridge 31000 by using a head control signal line 21021 to control printing operation. In this case, the encoder signal (ENC) 21020 is an output signal from the encoder sensor 20004 (FIG. 7), which is input through the flexible flat cable 20012. The head control signal through the signal line 21021 is supplied to the printhead cartridge 31000 via the flexible flat cable 20012, the carriage board 20013 and contact FPC 20011.

Figure 9:
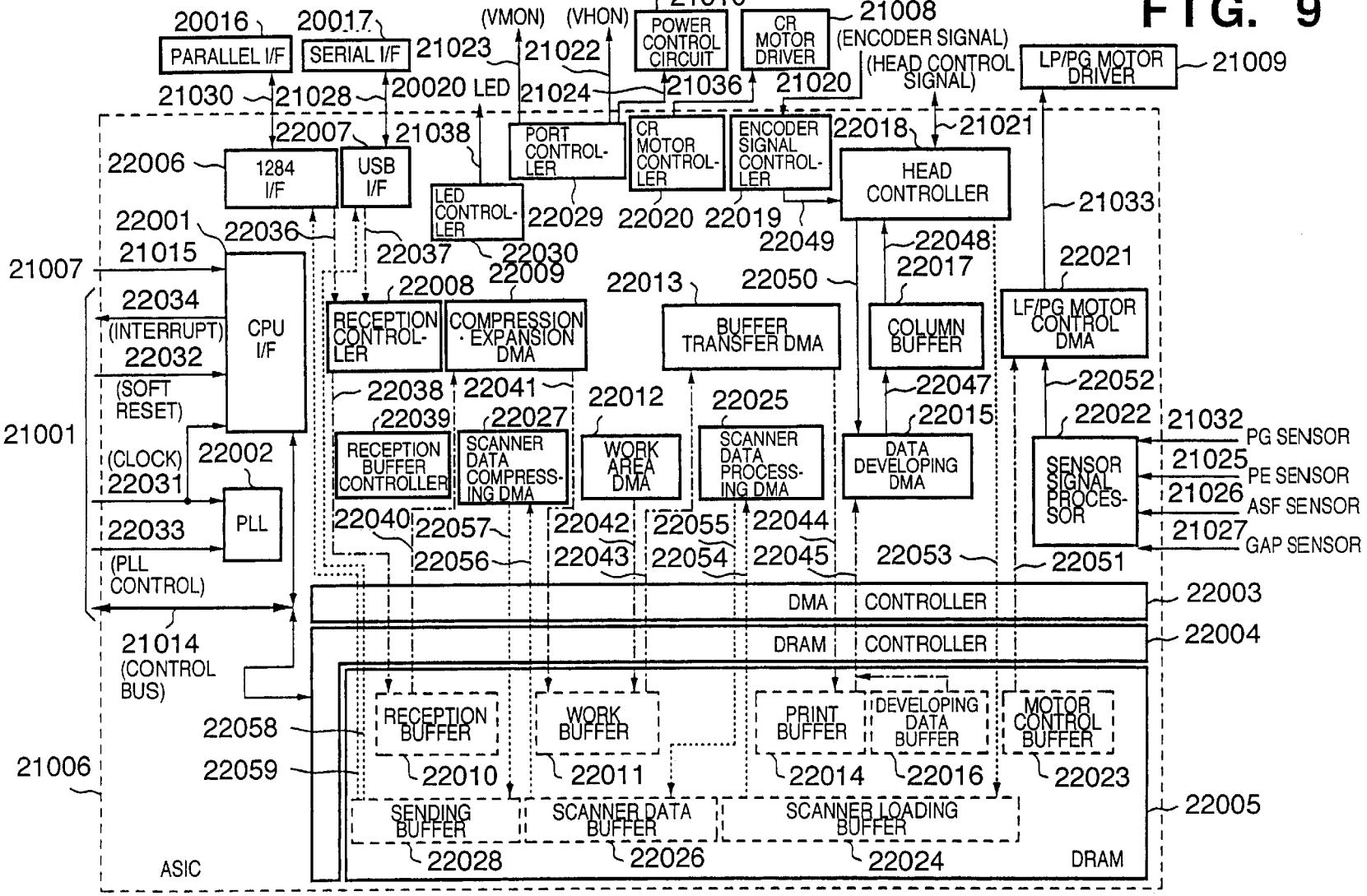
FIG. 9 is a block diagram showing the internal arrangement of an ASIC in FIG. 8.

FIG. 9 is a block diagram showing the internal arrangement of the ASIC 21006 according to this embodiment. With regard to connections between the respective blocks, FIG. 9 shows only the flows of data associated with control on the printhead and respective mechanical components, such as print data and motor control data, and omits an illustration of the flows of control signals and clocks associated with the read/write operations of the registers incorporated in the respective blocks, control signals associated with DMA control, and the like to avoid the complexity of the drawing.

Referring to FIG. 9, reference numeral 22002 denotes a PLL. As shown in FIG. 9, the PLL 22002 generates clocks (not shown) to be supplied to most components in the ASIC 21006 on the basis of a clock signal (CLK) 22031 and PLL control signal (PLLON) 22033 output from the CPU 21001. Reference numeral 22001 denotes a CPU interface (CPU I/F) for controlling register read/write operation with respect to each block to be described below in accordance with the reset signal 21015, a soft reset signal (PDWN) 22032 and the clock signal (CLK) 22031 supplied from the CPU 21001, and a control signal from the control bus 21014, performing clock supply to some blocks, reception of interrupt signals, and the like (none of which are shown), outputting an interrupt signal (INT) 22034 to the CPU 21001, and informing the occurrence of interruption in the ASIC 21006.

Reference numeral 22005 denotes a DRAM serving as a reception buffer 22010, work buffer 22011, print buffer 22014, developing data buffer 22016, and the like as data buffer for printing, and also having a motor control buffer 22023 for motor control. The DRAM 22005 also has a scanner loading buffer 22024, scanner data buffer 22026, sending buffer 22028, and the like as buffers to be used in the scanner operation mode in place of the respective printing data buffers.

In addition, the DRAM 22005 is used as a work area required for the operation of the CPU 21001. Reference numeral 22004 denotes a DRAM controller for performing read/write operation with respect to the DRAM 22005 by switching between access from the CPU 21001 to the DRAM 22005 and access from a DMA controller 22003 (to be described later) to the DRAM 22005.

The DMA controller 22003 receives requests (not shown) from the respective blocks and outputs, in write operation, write data (22038, 22041, 22044, 22053, 22055, and 22057) and the like to the DRAM controller 22004, together with address and control signals (not shown), to make DRAM access. In read operation, the DMA controller 22003 transfers read data (22040, 22043, 22045, 22051, 22054, 22056, 22058, and 22059) from the DRAM controller 22004 to blocks as request sources.

Reference numerals 22006 denotes a 1284 I/F for performing two-way interfacing with an external host unit (not shown) through the parallel I/F 20016 under the control of the CPU 21001 via the CPU I/F 22001. In printing operation, the 1284 I/F 22006 transfers reception data (PIF reception data 22036) from the parallel I/F 20016 to a reception controller 22008 by DMA processing. In scanner read operation, the 1284 I/F 22006 transmits the data (1284 transmission data (RDPIF) 22059) stored in the sending buffer 22028 in the DRAM 22005 to the parallel I/F 20016 by DMA processing.

Reference numeral 22007 denotes a USB I/F 22007 for performing two-way interfacing with an external host unit (not shown) through the serial I/F 20017 under the control of the CPU 21001 via the CPU I/F 22001. In printing operation, the USB I/F 22007 transfers reception data (USB reception data 22037) from the serial I/F 20017 to the reception controller 22008 by DMA processing. In scanner read operation, the USB I/F 22007 transmits the data (USB transmission data (RDUSB) 22058) stored in the sending buffer 22028 to the serial I/F 20017 by DMA processing. The reception controller 22008 writes the reception data (WDIF) 22038 from a selected one of the 1284 I/F 22006 and USB I/F 22007 at a write address in the reception buffer 22010 managed by a reception buffer controller 22039.

Reference numeral 22009 denotes a compression expansion DMA for reading out the reception data (raster data) stored in the reception buffer 22010 from a read address in the reception buffer 22010 managed by the reception buffer controller 22039, compressing/expanding the data (RDWK) 22040 in accordance with a designated mode, and writing the resultant data as the print code string (WDWK) 22041 in the work buffer 22011 under the control of the CPU 21001 via the CPU I/F 22001.

Reference numeral 22013 denotes a print buffer transfer DAM for reading out the print codes (RDWP) 22043 from the work buffer 22011, and transfers the respective print codes (WDWP 22044) upon rearranging them in accordance with the addresses in the print buffer 22014 to conform to the sequence of data transfer to the printhead cartridge 31000 under the control of the CPU 21001 via the CPU I/F 22001. Reference numeral 22012 denotes a work area DMA for repeatedly writing/transferring designated work file data (WDWF) 22042 with respect to that area of the work buffer 22011 to which data is completely transferred by the print buffer transfer DAM 22013 under the control of the CPU 21001 via the CPU I/F 22001.

Reference numeral 22015 denotes a data developing DMA for reading out the print codes rearranged and written in the print buffer 22014 and the developed data written in the developing data buffer 22016 in response to a data developing timing signal 22050 from a head controller 22018 as a trigger, generating the expanded print data (RDHDG) 22045, and writing it as column buffer write data (WDHDG) 22047 in a column buffer 22017 under the control of the CPU 21001 via the CPU I/F 22001. In this case, the column buffer 22017 is an SRAM for temporarily storing transfer data (expanded print data) to the printhead cartridge 31000. The column buffer 22017 is shared/managed by two blocks, i.e., the data developing DMA 22015 and head controller 22018 through handshake signals (not shown).

The head controller 22018 interfaces with the printhead cartridge 31000 or scanner through head control signals under the control of the CPU 21001 via the CPU I/F 22001, and outputs the data developing timing signal 22050 to the data developing DMA 22015 on the basis of a head driving timing signal 22049 from an encoder signal controller 22019.

In printing operation, the head controller 22018 reads out expanded print data (RDHD) 22048 from the column buffer 22017 in accordance with the head driving timing signal 22049, and outputs the data to the printhead cartridge 31000 through the head control signal line 21021.

In the scanner read mode, the head controller 22018 DMA-transfers the loaded data (WDHD) 22053 input through the head control signal line 21021, to the scanner loading buffer 22024 of the DRAM 22005. Reference numeral 22025 denotes a scanner data processing DMA for reading out the read data (RDAV) 22054 stored in the scanner loading buffer 22024 and writes the processed data (WDAV) 22055 having undergone averaging and the like in the scanner data buffer 22026 of the DRAM 22005 under the control of the CPU 21001 via the CPU I/F 22001.

Reference numeral 22027 denotes a scanner data compressing DMA for reading out the processed data (RDYC) 22056 from the scanner data buffer 22026, compressing the read data, and writing the compressed data (WDYC) 22057 in the sending buffer 22028 under the control of the CPU 21001 via the CPU I/F 22001.

The encoder signal controller 22019 receives the encoder signal (ENC) 21020 and outputs the head driving timing signal 22049 in accordance with a predetermined mode under the control of the CPU 21001. The encoder signal controller 22019 also stores information associated with the position and speed of the carriage 14001, obtained from the encoder signal 21020, in a register and provides it for the CPU 21001. The CPU 21001 determines various parameters for control on the CR motor 20001 on the basis of this information. Reference numeral 22020 denotes a CR motor controller for outputting the CR motor control signal 21036 under the control of the CPU 21001 via the CPU I/F 22001.

Reference numeral 22022 denotes a sensor signal processor for receiving detection signals output from the PG sensor 20010, PE sensor 20007, ASF sensor 20009, GAP sensor 20008, and the like and transfers these pieces of sensor information to the CPU 21001 in accordance with a predetermined mode under the control of the CPU 21001. The sensor signal processor 22022 also outputs a sensor detection signal 22052 to an LF/PG motor control DMA 22021.

The LF/PG motor control DMA 22021 reads out the pulse motor driving table (RDPM) 22051 from the DRAM 22005 and outputs it to the pulse motor control signal 21033 under the control of the CPU 21001 via the CPU I/F 22001. The LF/PG motor control DMA 22021 also outputs the pulse motor control signal 21033 in response to the above sensor detection signal as a trigger for control depending on the operation mode.

Reference numeral 22030 denotes an LED controller for outputting the LED driving signal 21038 under the control of the CPU 21001 via the CPU I/F 22001; and numeral 22029 denotes a port controller for outputting the head power ON signal 21022, motor power ON signal 21023, and power control signal 21024 under the control of the CPU 21001 via the CPU I/F 22001.

Figure 10:
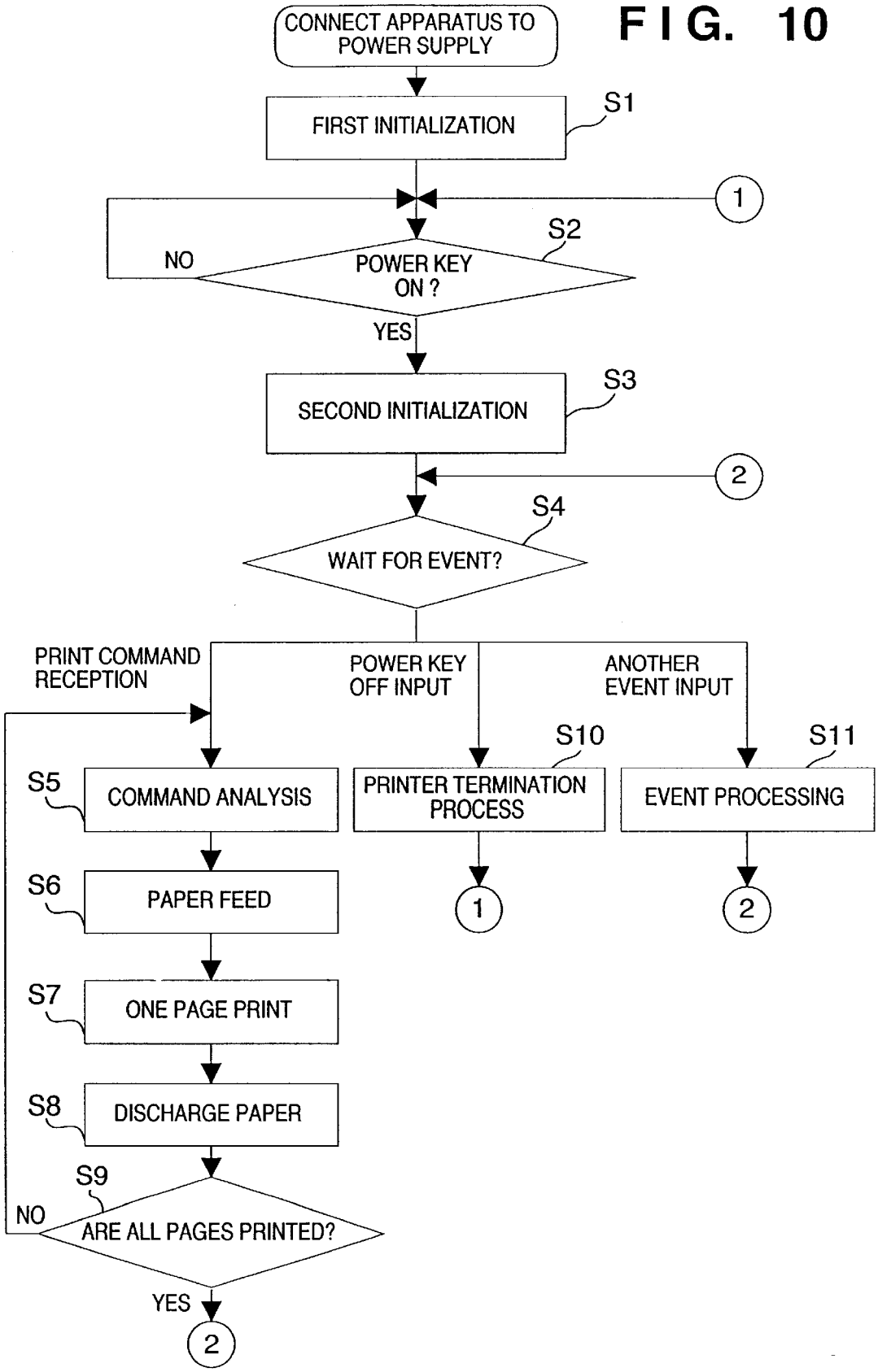
FIG. 10 is a flow chart showing the operation of the ink-jet printer according to this embodiment.

The operation of the ink-jet printer according to this embodiment having the above arrangement will be described next with reference to the flow chart of FIG. 10.

When this apparatus is connected to an AC power supply, first initialization of the apparatus is performed in step S1. In this initialization processing, electrical systems such as the ROM and RAM of this apparatus are checked to ensure the electrically normal operation of this apparatus. In step S2, it is checked whether the power key 20018 on the upper case 11002 of the main body 11000 is turned on. If the power key 20018 is pressed, the flow advances to step S3 to perform second initialization.

In the second initialization, the respective driving mechanisms, printhead, and its driving circuits in this apparatus are checked. That is, in initializing the respective motors and reading head information, it is checked whether the ink-jet printer can normally operate.

In step S4, the inputting of an event is waited. More specifically, command events from the external I/Fs such as the parallel I/F 20016 and serial I/F 20017, events input through panel keys operated by the user, internal control events, and the like for this printer are monitored. When such an event is generated, processing corresponding to the event is executed. If, for example, a print command event from an external I/F is received in step S4, the flow advances to step S5. If a power key event is generated by user operation in step S4, the flow advances to step S10. If another event is generated in step S4, the flow advances to step S11.

In step S5, the print command input through the external I/F is analyzed to determine a designated paper type, printing sheet size, print quality, paper feed method, and the like, and data representing the determination result is stored in the DRAM 22005 in this printer. The flow then advances to step S6. In step S6, paper feed is started to feed a printing sheet to a printing start position by the paper feed method designated in step S5, and the flow advances to step S7. In step S7, printing operation of one page is performed. In this printing operation, the print data input through the external I/F is temporarily stored in the print buffer 22014, and the CR motor 20001 is rotated to start moving the carriage 14001 in the main scanning direction. At the same time, the print data stored in the print buffer 22014 is supplied to the printhead cartridge 31000 to print one line. When printing operation corresponding to 1-line print data is complete, the LF motor 20002 is rotated to rotate an LF roller 13002 (FIG. 2) to feed the printing sheet for one line in the sub-scanning direction. Thereafter, the above operation is repeatedly executed. When 1-page print data from the external I/F is completely printed in step S7, the flow advances to step S8.

In step S8, the LF motor 20002 is driven to rotate the paper discharge roller to repeatedly feed the printing sheet until it is determined that the printing sheet is completely fed out of the printer. When the feeding of the printed sheet is complete, the printed sheet is completely discharged onto the tray 11004*a*. The flow then advances to step S9 to check whether all pages to be printed are completely printed. If all printing data to be printed is not printed, the flow returns to step S5 to repeat the above operation in steps S5 to S9. When all the pages to be printed are completely printed, the printing operation is terminated. The flow then advances to step S4 to wait for another event.

If it is determined in step S4 that a power key event is generated, the flow advances to step S10 to perform a printer termination process so as to stop the operation of the printer. More specifically, to power off the respective motors and head, the printer is shifted to a state where the power supply can be turned off, and the power supply is turned off. The flow then advances to step S2 to wait until the power key 20018 is turned on next.

If another event is generated, the flow advances from step S4 to step S11 to perform event processing other than that described above. For example, processing corresponding to a recovery command from panel keys on the printer or an external I/F or a recovery event that is generated internally is performed. Note that after the processing, the flow advances to step S4 to wait for another event.

Figure 11:
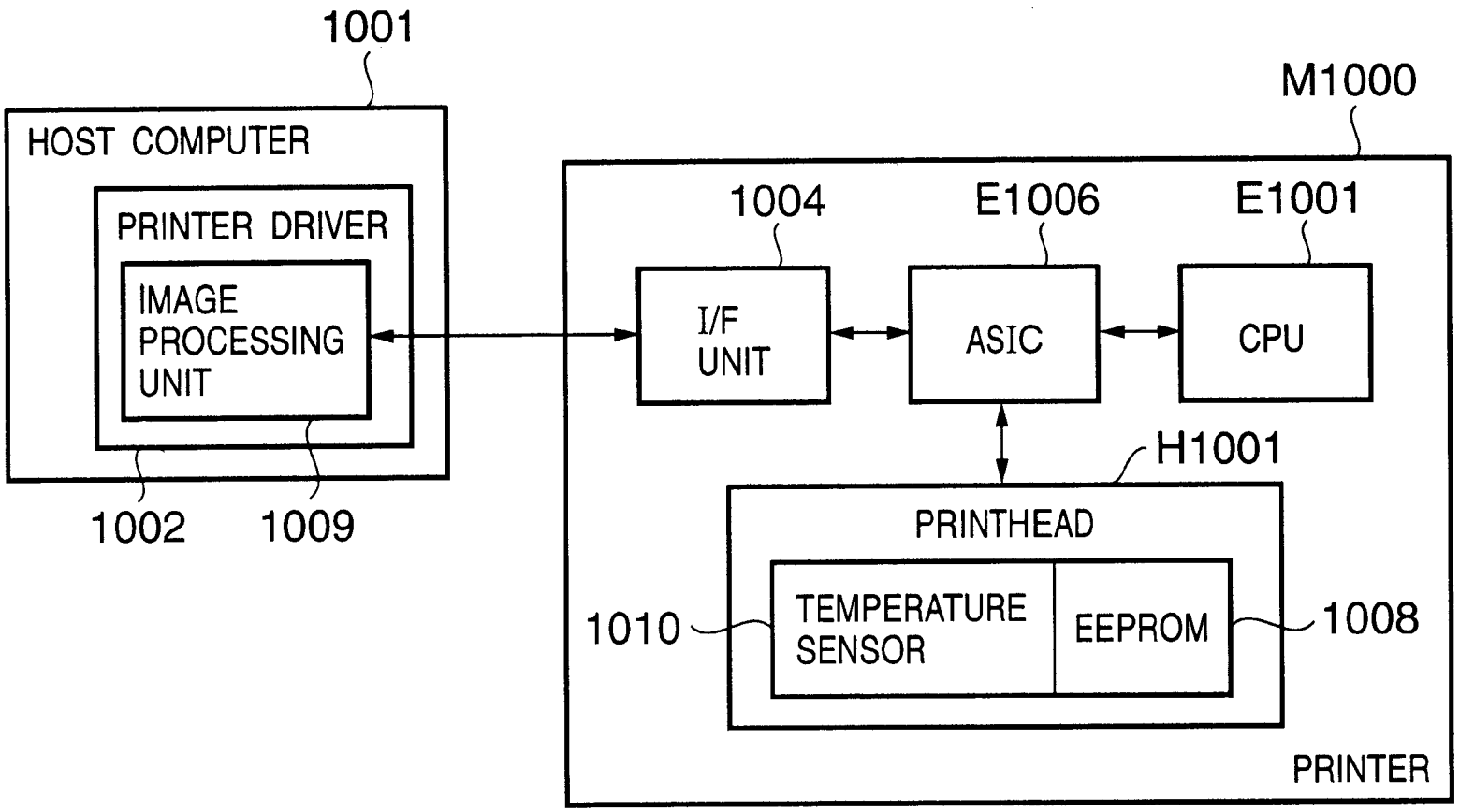
FIG. 11 is a view showing a printing system using the ink-jet printer according to this embodiment of the present invention.

FIG. 11 is a block diagram showing the arrangement of a printing system including the ink-jet printer 11000 according to the first embodiment of the present invention.

Referring to FIG. 11, reference numeral 1001 denotes a host computer which outputs the image data generated by executing, for example, an application program or the like to the ink-jet printer 11000; and numeral 1002 denotes a printer driver for performing image processing for the image data received from the application program in the host computer 1001 by using an image processing unit 1009, generating a print instruction, print data, and the like for the ink-jet printer 11000 on the basis of the processed image data, and outputting them to the ink-jet printer 11000. In addition, the printer driver 1002 receives status information such as error information from the ink-jet printer 11000 or receives ink discharge amount information, head identification information, and the like about the printhead (ink-jet head) 31001 by two-way communication, and changes the image processing methods in the image processing unit 1009 in accordance with the received information.

The arrangement of the ink-jet printer 11000 will be described next.

The ASIC (Application Specialized for Integrated Circuit) 21006 exchanges data with the host computer 1001 through an I/F unit 1004 in the ink-jet printer 11000. The CPU 21001 controls the overall operation of the ink-jet printer 11000 by exchanging data signals and control signals with the ASIC 21006. The ASIC 21006 also exchanges head control signals with the ink-jet head (printhead) 31001. The CPU 21001 performs various control operations to drive the printhead 31001 by receiving control signals for the respective heads through the ASIC 21006. An EEPROM 1008 storing various pieces of information about the printhead 31001 is mounted in the printhead 31001. The contents of the EEPROM 1008 are transferred to the CPU 21001 through the ASIC 21006 at a predetermined timing. The printhead 31001 also has a temperature sensor 1010 for detecting the temperature of the printhead 31001.

As described above, the printhead 31001 in the ink-jet printer 11000 according to this embodiment is designed such that print element boards for a total of six colors, i.e., Y, M, C, K, LC, and LM are mounted on one printhead unit to obtain a photo-, high-quality image.

Figure 12:
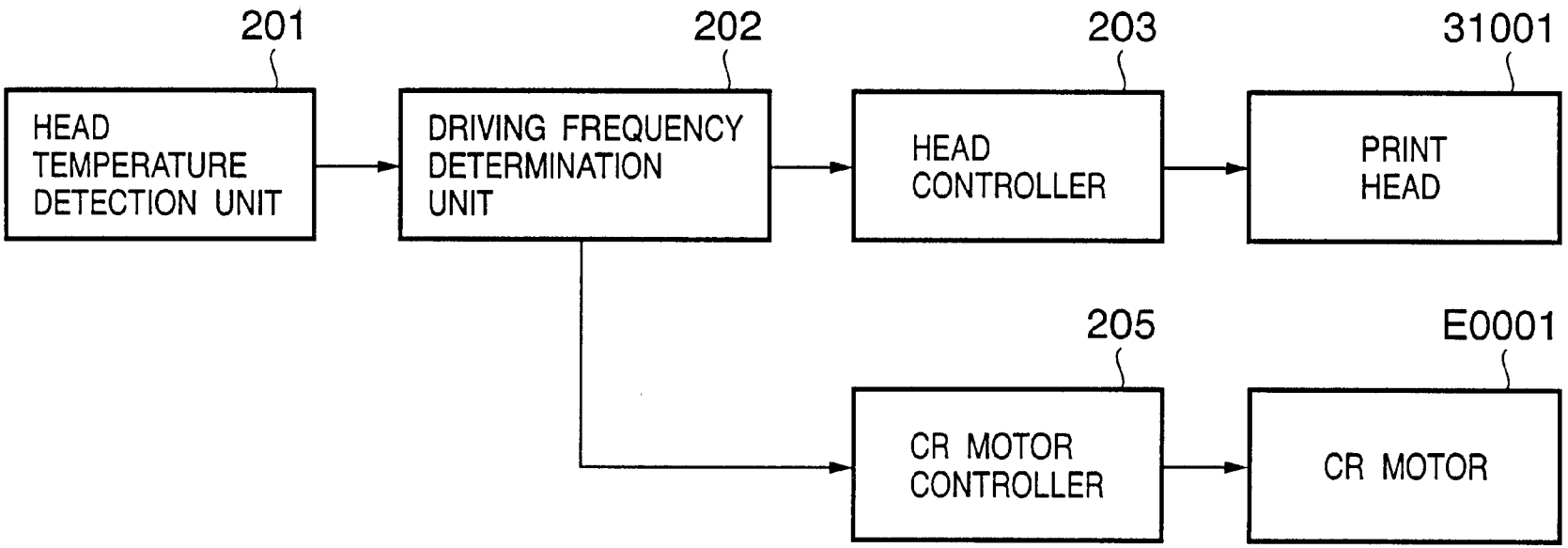
FIG. 12 is a block diagram showing the functional arrangement of the main part of the printer according to this embodiment.

FIG. 12 is a block diagram for explaining a functional arrangement for driving the printhead in the ink-jet printer 11000 according to this embodiment.

Referring to FIG. 12, reference numeral 201 denotes a head temperature detection unit for detecting the temperature of the printhead on the basis of an output from the temperature sensor 1010 mounted on the printhead 31001 and outputting a detection signal. The head temperature detection unit 201 according to this embodiment incorporates the temperature sensor 1010 for detecting a temperature and an A/D conversion circuit for converting the analog signal output from the temperature sensor 1010 into a digital signal, and outputs a digital signal corresponding to the head temperature. Reference numeral 203 denotes a head controller for printing an image by driving the electrothermal transducer mounted in each nozzle of the printhead 31001 in accordance with the driving frequency determined by a driving frequency determination unit 202 and image data to be printed. The carriage (CR) motor 20001 serves to scan the printhead 31001 in the main scanning direction. Reference numeral 205 denotes a carriage motor controller for rotating the carriage motor 20001 in accordance with the driving frequency determined by the driving frequency determination unit 202.

FIG. 13 is a view showing the relationship between the temperature detection signal (digital temperature information) output from the head temperature detection unit 201 and the actual temperature of the printhead 31001.

Figure 14:
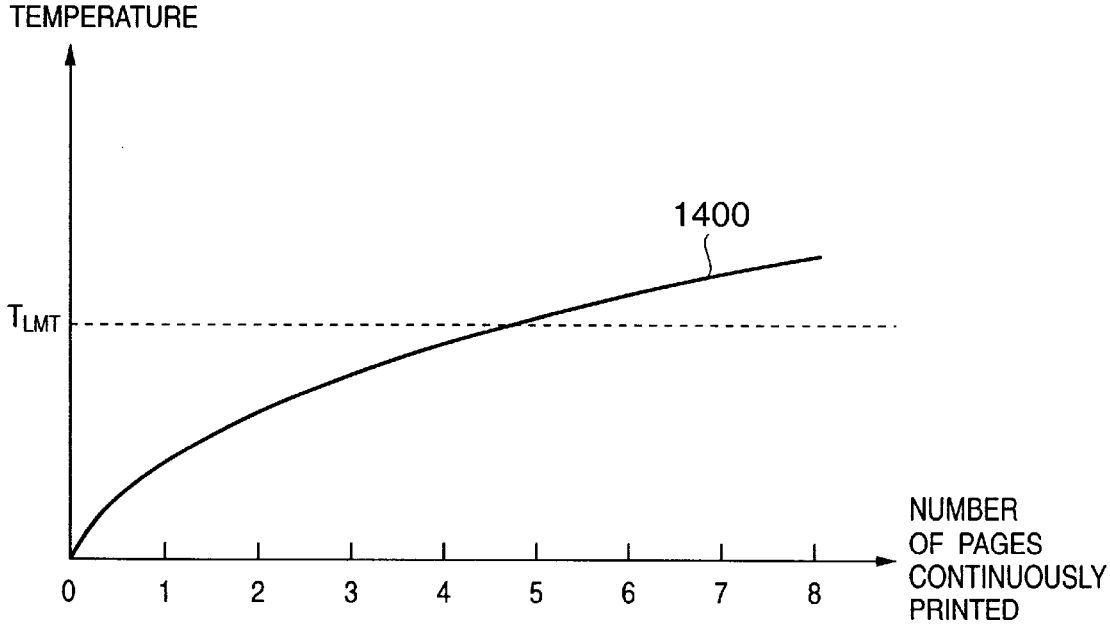
FIG. 14 is a graph for explaining the temperature rise characteristics of an ink-jet printer according to this embodiment in continuous printing operation.

FIG. 14 is a graph for explaining the relationship between the number of pages continuously printed and the temperature of the printhead.

The driving frequency determination unit 202 changes the head driving frequency in printing operation on the basis of the digital temperature information output from the head temperature detection unit 201. In the printhead 31001 according to this embodiment, as indicated by reference numeral 1400 in FIG. 14, when images with a predetermined duty are continuously printed by a plurality of pages, the head temperature rises in accordance with the number of pages continuously printed. If this head temperature exceeds a limit temperature (TLMT) in FIG. 14, the printhead 31001 discharges ink unstably, resulting in a deterioration in the image quality of a printed image.

Figure 15:
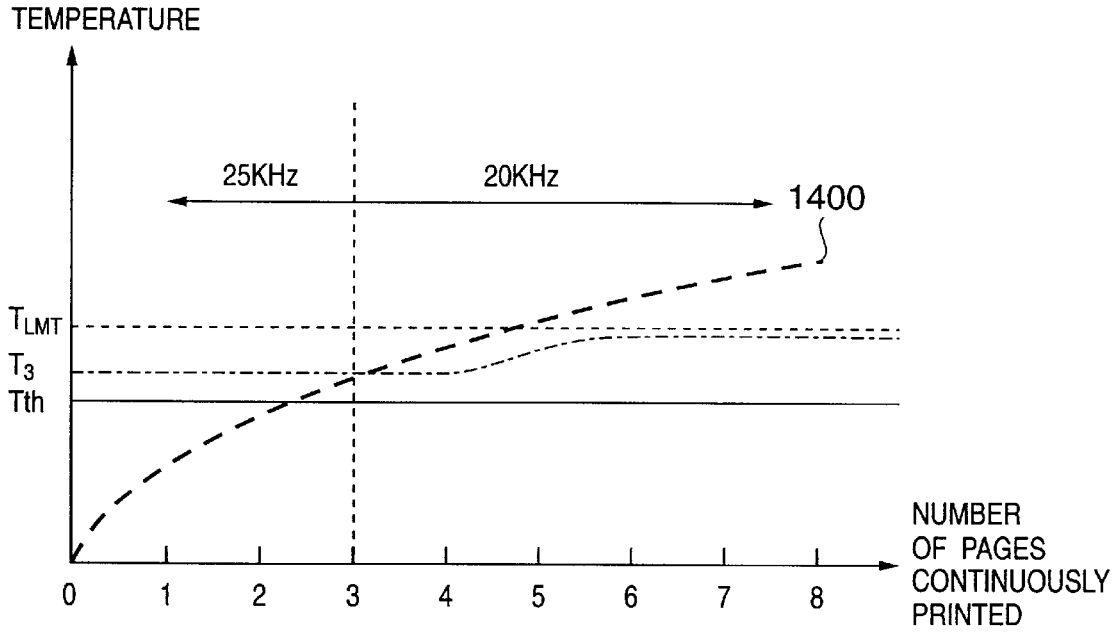
FIG. 15 is a graph for explaining a threshold temperature for switching of driving frequencies according to the first embodiment.

As shown in FIG. 15, therefore, a threshold temperature (Tth) is set to be lower than the limit temperature (TLMT) at which a deterioration in image quality occurs. If the head temperature exceeds this threshold temperature (Tth), the driving frequency of the printhead 31001 is decreased from 25 KHz (normal) to 20 KHz at the start of printing of the corresponding page. Note that reference numeral 1400 in FIG. 15 indicates the relationship between the number of pages continuously printed and the temperature of the printhead as shown in FIG. 14.

Figure 16:
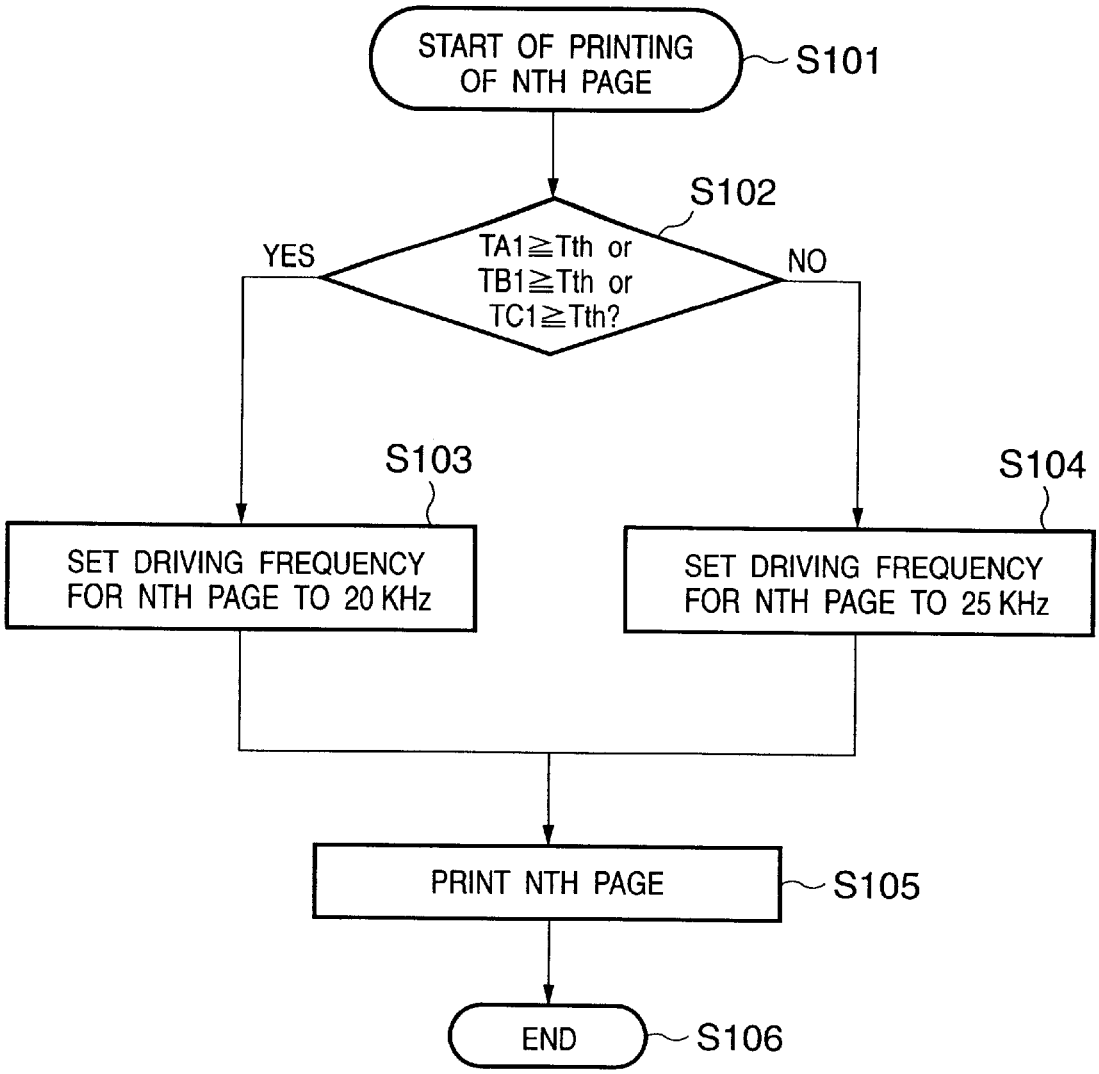
FIG. 16 is a flow chart for explaining driving frequency determination processing in the driving frequency determination unit of the ink-jet printer according to this embodiment.

FIG. 16 is a flow chart showing the flow of determination processing for a driving frequency in the driving frequency determination unit 202.

Figure 17:
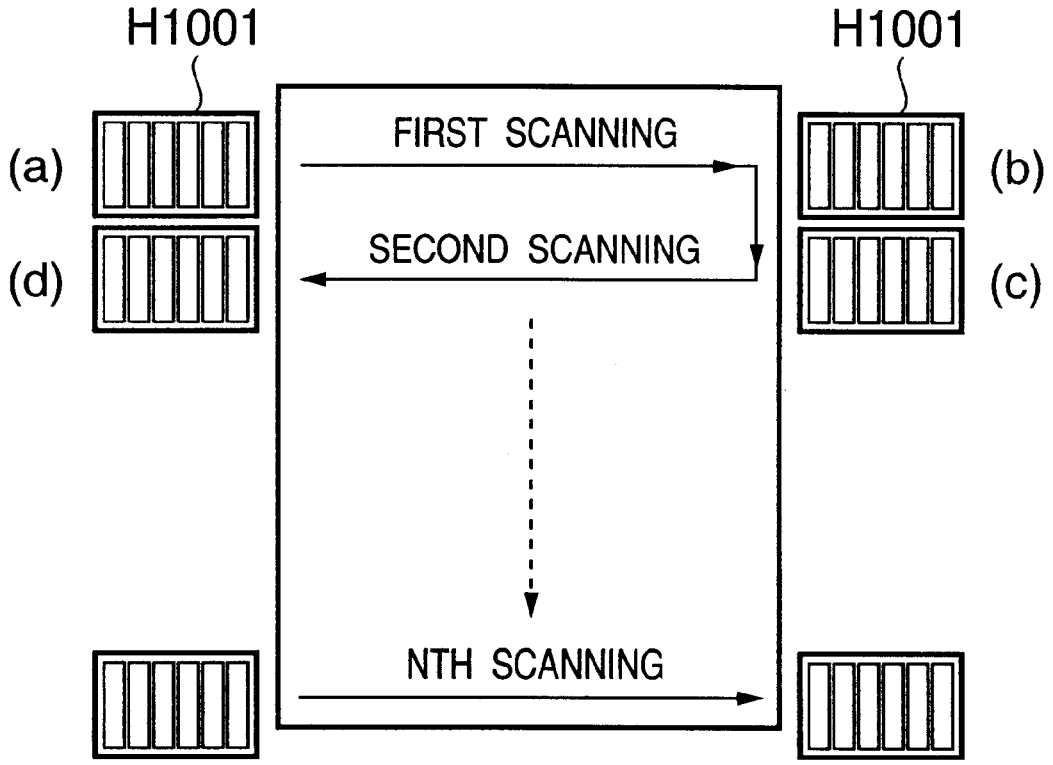
FIG. 17 is a view for explaining how each printhead is scanned to print an image on one page.

This determination processing is performed at the start of printing of each page. As shown in FIG. 17, when printing is to be sequentially performed from the first scanning operation of scanning the printhead 31001 from (a) to (b), to the second scanning operation of scanning the printhead from (c) to (d), and the Nth scanning operation of scanning the printhead to the end of the page, the temperature of the printhead 31001 is acquired from the head temperature detection unit 201 immediately before printing from (a) in the first scanning operation, and the corresponding processing is started.

In step S102, the acquired temperature of the printhead 31001 is compared with the threshold temperature (Tth) at which the driving frequency is switched to another frequency.

Figure 18:
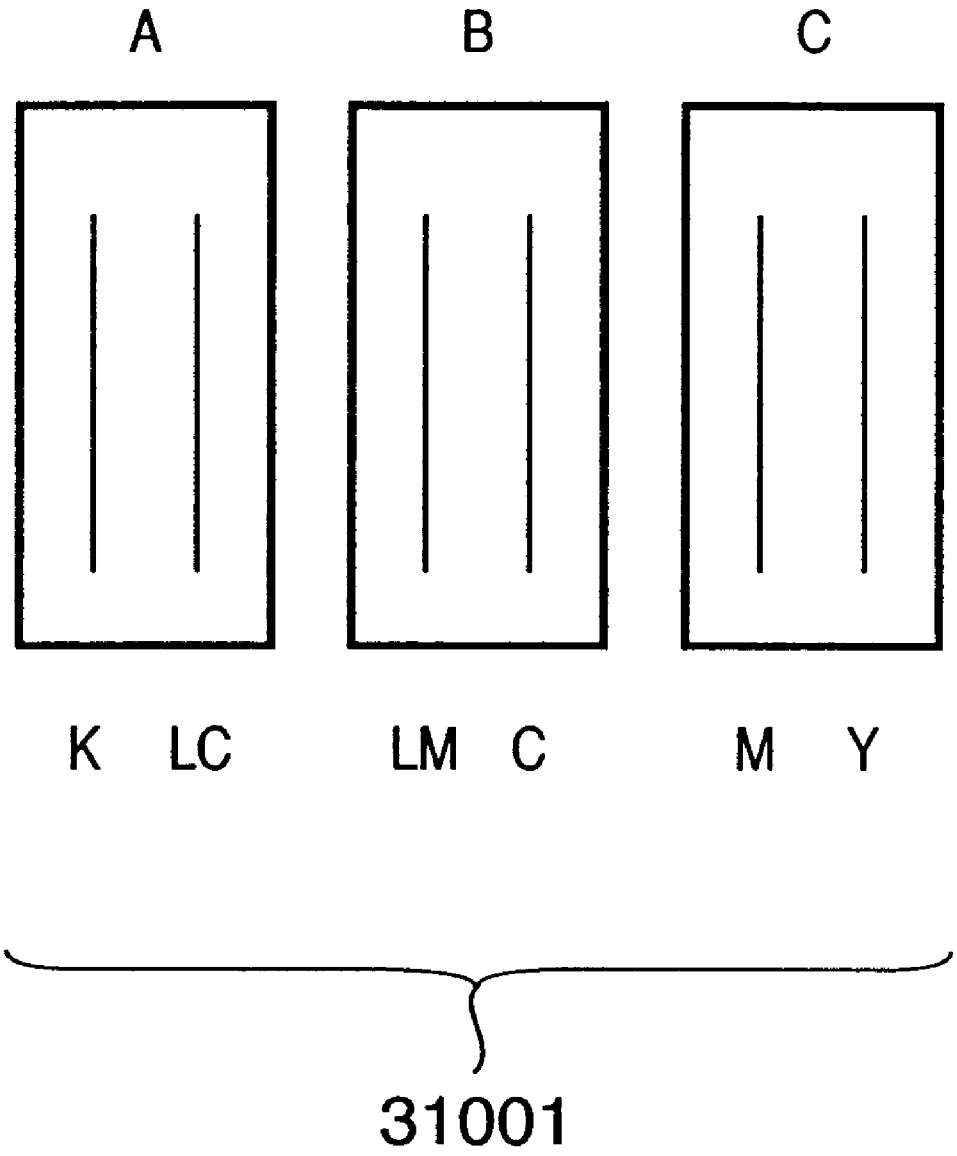
FIG. 18 is a view for explaining the chip arrangement of the printhead according to this embodiment.

In the printhead 31001 according to this embodiment, as shown in FIG. 18, printheads corresponding to two colors are integrated into one chip (head substrate). More specifically, K (black) and LC (light cyan) heads are arranged on a chip A; LM (light magenta) and C (cyan) heads, on a chip B; and M (magenta) and Y (yellow) heads, on a chip C. The temperature sensor 1010 described above is provided for each chip.

Pieces of digital temperature information about the temperature of the respective chips are respectively represented by TAn, TBn, and TCn in the nth scanning operation in accordance with the number of times of scanning of the printhead 31001. Temperatures TA1, TB1, and TC1 of the respective chips in the first scanning operation are compared with the above threshold temperature Tth. If the temperature of at least one chip equals or exceeds the threshold temperature Tth, the flow advances to step S103 to set the driving frequency for printing on the corresponding page to 20 KHz.

If none of the chip temperatures is less than the threshold temperature Tth, the flow advances to step S104 to set the driving frequency for printing on the corresponding page to 25 KHz which is the normal driving frequency.

The head controller 203 sets an optimal driving pulse width and driving period corresponding to the driving frequency determined by the driving frequency determination unit 202, and drives the printhead 31001 by supplying a pulse signal to the head. The CR motor controller 205 controls the driving operation of the carriage motor 20001 by supplying an optimal CR motor driving signal to the carriage motor 20001 so as to scan the carriage 14001 at a traveling speed corresponding to the driving frequency determined by the driving frequency determination unit 202.

The manner in which the threshold head temperature Tth is set in changing the driving frequency will be described below with reference to FIG. 15.

FIG. 15 is a graph showing head temperature rise characteristics based on the number of pages continuously printed with the upper limit of duty with which a 1-page image can be printed.

In this case, the temperature of the printhead exceeds the limit temperature TLMT, at which ink refill operation becomes insufficient due to a rise in temperature, in the process of printing on the fourth page. Therefore, the threshold temperature Tth is set to a temperature which is lower than a head temperature T3 at the time of printing on the start of the third page and can be set in increments of 5° C. corresponding to the resolution of digital temperature outputs in FIG. 13.

In the embodiment described above, the detection timing of a head temperature is set at the start of printing of each page. If, however, a head temperature cannot be determined at the start of printing of each page owing to the acquisition timing of a head temperature and a determination processing time, a head temperature may be detected at the end of printing of each preceding page. In this case, a threshold temperature at which the driving frequency is to be changed must be set to be slightly higher than that determined upon detection of a head temperature at the start of a page, in consideration of a drop in temperature during the time period required to start printing of the next page from the end of printing of the page.

The above arrangement can reliably prevent a deterioration in printed images due to a deterioration in ink refill characteristics which is caused by a rise in head temperature when images are continuously printed. In addition, the above arrangement can minimize a decrease in throughput of printing due to a decrease in head driving frequency.

According to this embodiment, driving frequencies are switched in unit of a page such as a unit of printed area which images are separately printed. This makes it possible to prevent a deterioration in images, such as disturbances in printed images and the generation of streaks, which is caused when driving frequencies are switched in the process of printing on one page. The unit in which driving frequencies are switched may be an area in which images have been changed, but it is preferable to be a unit of a separated image area.

[Second Embodiment]

The second embodiment of the present invention will be described next. According to a characteristic feature of the second embodiment, the driving frequency is controlled in a unit of object as a separated image on a page.

Figure 19:
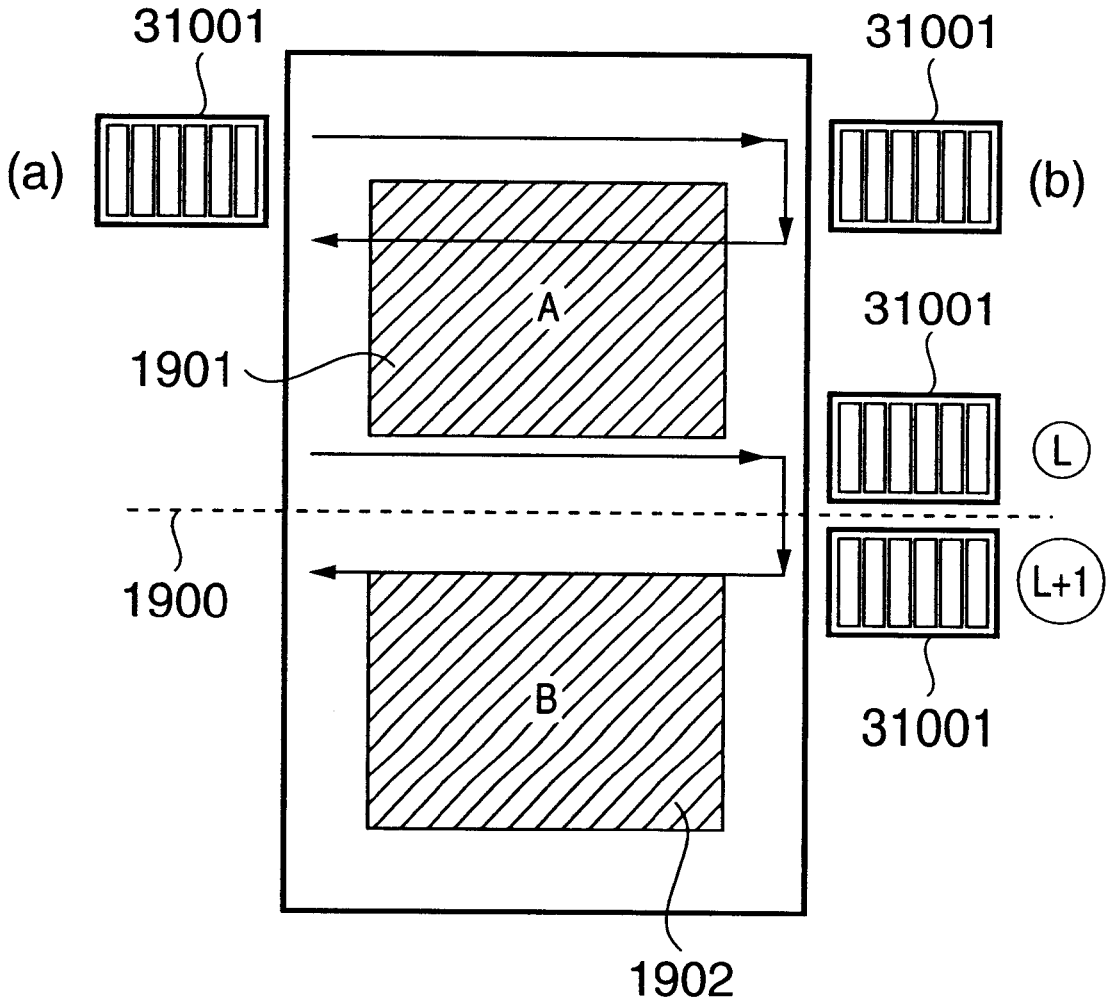
FIG. 19 is a view for explaining separate printed images according to the second embodiment of the present invention.

When images on one page exist in two print areas 1901 and 1902 indicated by the hatching in FIG. 19, and the print areas 1901 and 1902 are separated on the two sides of a dashed line 1900 in FIG. 19 drawn almost in the middle of the page, optimal driving frequencies are set for the respective print areas 1901 and 1902. That is, driving frequencies are switched in units of objects located on two sides of lines (blank lines), of lines extending in the main scanning direction of a printhead 31001, on which no image is printed. As the number of blank lines increases, the difference in printed state between the two objects becomes less conspicuous.

Figure 20:
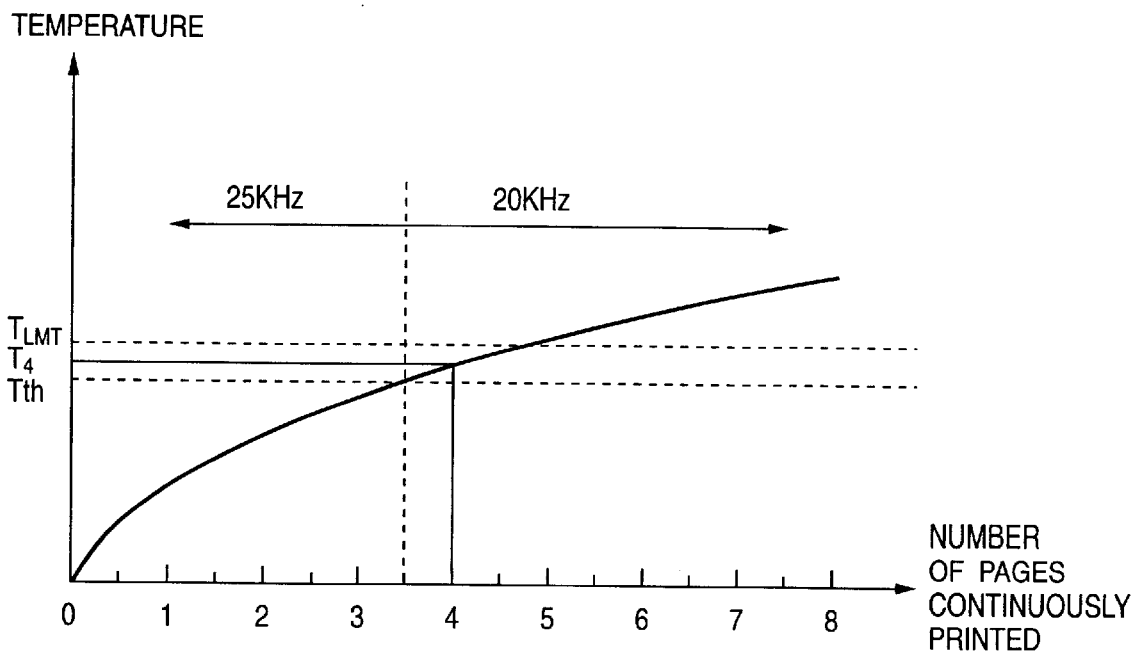
FIG. 20 is a graph for explaining a threshold temperature for switching of driving frequencies according to the second embodiment of the present invention.

Referring to FIG. 20, as in the first embodiment described above, when temperature rise characteristics in printing with the upper limit of duty with which printing can be performed within a page are viewed as a rise in temperature on a half-page basis, it is expected that the head temperature will exceed a limit temperature TLMT, at which an image deterioration is caused by insufficient ink refill operation with a rise in head temperature, near about 4.5 pages.

Therefore, a threshold temperature Tth' is set, which is lower than a head temperature T4 at the start of printing of the fourth page, i.e., half-page ahead of the above position, by one rank. With this operation, printing can be performed at 25 KHz, which is the normal driving frequency, for a period of time longer by half page than that when driving frequencies are switched on a page basis as in the first embodiment.

In the second embodiment, in order to perform driving frequency switching control on a half-page basis as in the above manner, it must be checked whether image print areas are separated on two sides of the boundary between the half pages as shown in FIG. 19.

Figure 21:
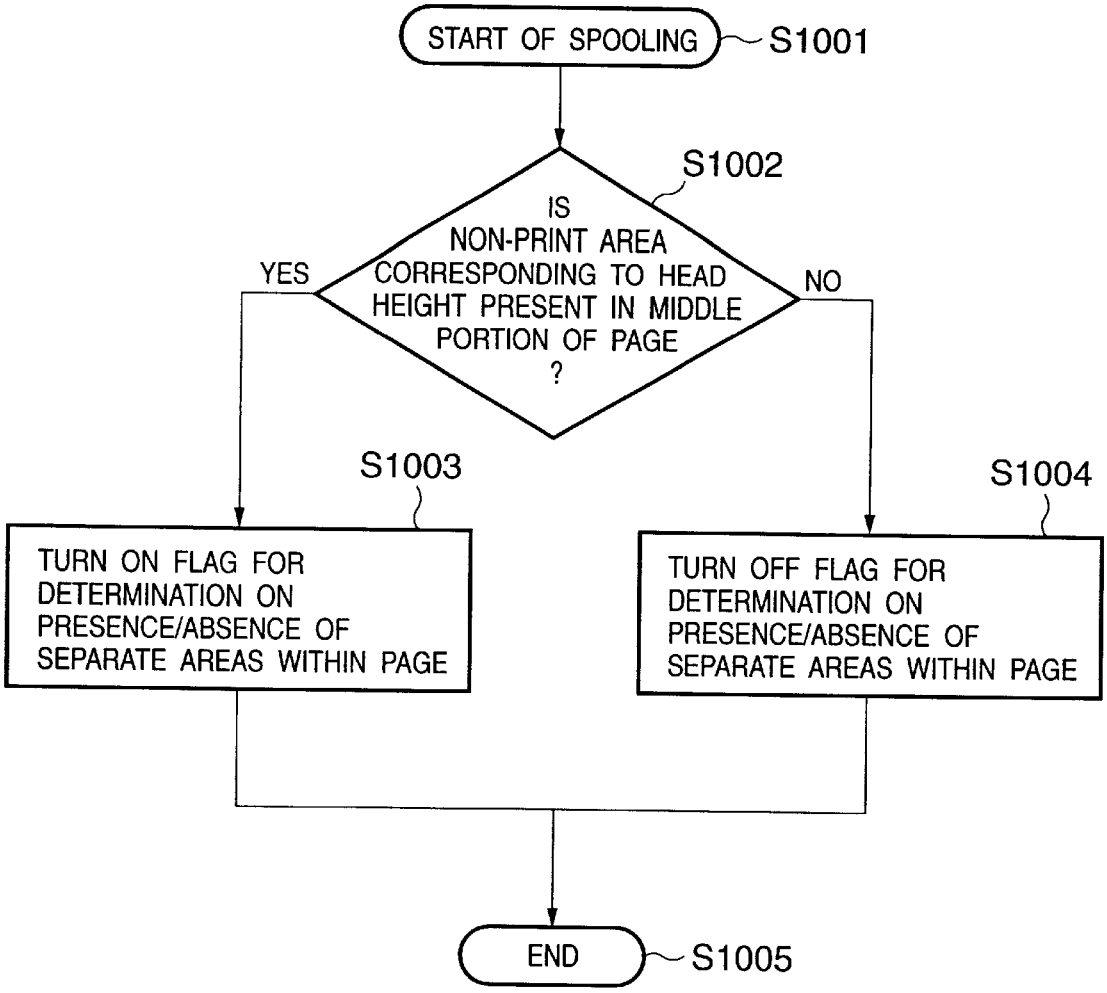
FIG. 21 is a flow chart showing a procedure for determining whether print areas are separated within one page according to the second embodiment.

FIG. 21 is a flow chart showing a procedure for determining a driving frequency for each print area according to the second embodiment of the present invention. This processing is performed during spooling in a printer driver 1002.

After spooling is started in step S1001, it is checked in step S1002 whether a non-print area corresponding to the height of the printhead 31001 exists in almost the middle portion of the page.

Figure 22:
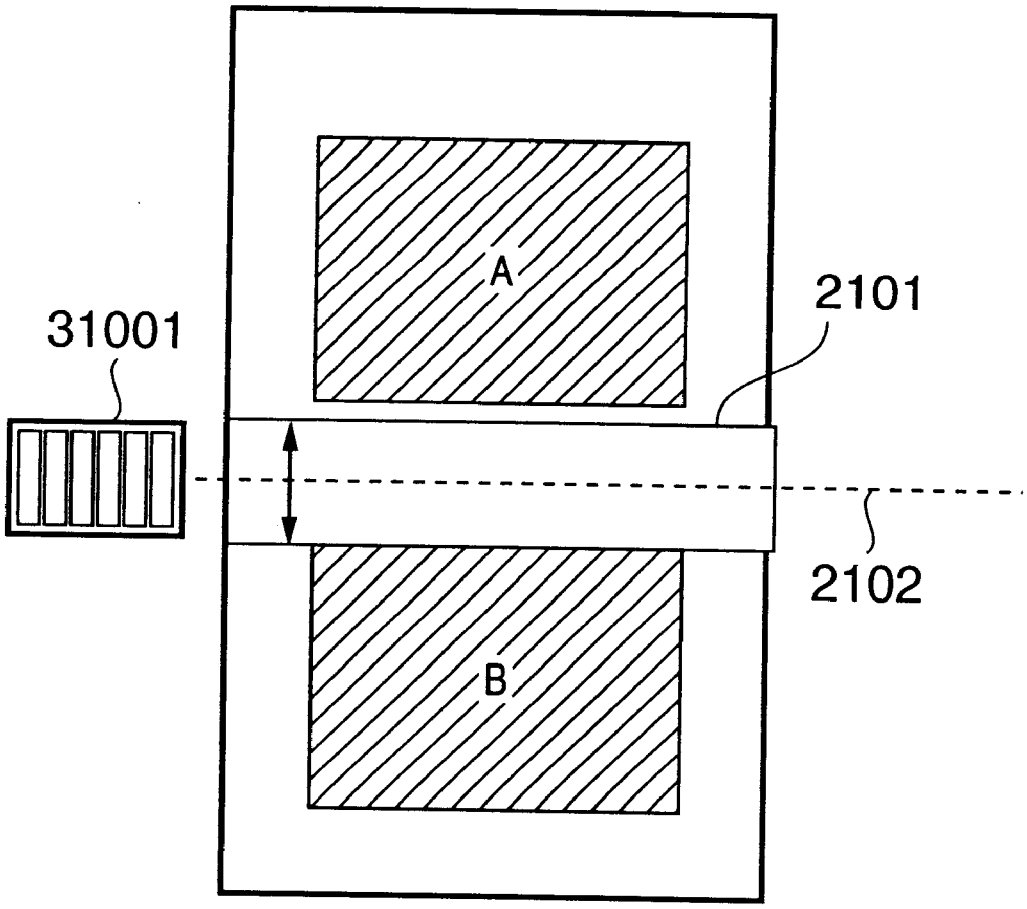
FIG. 22 is a view for explaining a determination area for determining whether print areas are separated according to the second embodiment of the present invention.

A criterion for this determination is to check whether a non-print area is present in an area 2101 in FIG. 22 which has a width almost equal to the height of the printhead, centered on a page middle portion 2102, as shown in FIG. 22, i.e., whether images are to be separately printed in the vertical direction within one page. If it is determined on the basis of this determination result that no print area exists in the area 2101, it is determined that page images are separated, and the flow advances to step S1003 to turn on a flag for determination on the presence/absence of separate areas. If it is determined in step S1002 that a print area exists in the area 2101, the flow advances to step S1004 to turn off the determination flag upon determining that images are not separated within the page.

In the second embodiment, it is checked whether a non-print area exists in substantially the middle portion of a page. However, the present invention is not limited to this. This determination may be performed at any place within one page as well as substantially the middle portion, and the central position (corresponding to 2102 in FIG. 22) at which the non-print area 2101 is present may be transferred to a printer 11000, together with the corresponding determination flag, thus executing the processing in FIG. 23 (described later).

After the determination processing in FIG. 21 is performed by the printer driver 1002, the ON/OFF information about the flag for determination on the presence/absence of separate print areas within the page is transferred from the printer driver 1002 to the printer 11000 before printing, as shown in FIG. 23.

FIG. 23 is a flow chart showing driving frequency determination processing in the ink-jet printer 11000 according to the second embodiment of the present invention.

In step S1202, it is checked whether the determination flag received from the printer driver 1002 is ON/OFF. If this determination flag is OFF, i.e., print areas of one page are not separated as shown in FIG. 22, then the processing in steps S1203 to S1206 according to the first embodiment is executed. Since the processing in steps S1203 to S1206 is the same as that in the flow chart of FIG. 16, a description thereof will be omitted.

If it is determined in step S1202 that the determination flag is ON, the flow advances to step S1207 to check whether each of the head temperatures (TA1, TB1, TC1) is equal to or higher than the threshold temperature Tth'. As shown in FIG. 20, this threshold temperature Tth' is set to be slightly higher than the threshold temperature Tth (FIG. 15) (Tth'>Tth) which is set when driving frequency determination is performed on a page basis in the first embodiment described above. If it is determined in step S1207 that at least one of the chip temperatures is equal to or higher than the threshold temperature Tth', the flow advances to step S1208 to set the driving frequency for printing on the first half portion of the page to 20 KHz.

If each chip temperature is less than the threshold temperature Tth', the flow advances to step S1209 to set the driving frequency for printing on the first half portion of the page to 25 KHz.

When a driving frequency is set in step S1208 or S1209 in this manner, the flow advances to step S1210 to print an area A in FIG. 22 at the driving frequency set in step S1208 or S1209.

The flow then advances to step S1211 to determine the driving frequency for printing on the second half portion of the page. Assume that the scanning start position of the second half portion of the page corresponds to the 100th scanning operation. The corresponding head temperatures (TA100, TB100, TC100) are compared with the threshold temperature Tth'. If at least one chip temperature is equal to or higher than the threshold temperature Tth', the flow advances to step S1212 to set the driving frequency for printing on the second half portion of the page to 20 KHz. If each chip temperature is less than the threshold temperature Tth', the flow advances to step S1213 to set the driving frequency for printing on the second half portion of the page to 25 KHz.

The flow then advances to step S1214 to print the second half portion of the page at the driving frequency set in step S1212 or S1213. When the second half portion is completely printed in this manner, the flow advances to step S1215 to terminate image printing on the page.

In the second embodiment, it is checked whether image areas are separated at substantially the middle portion of one page, and different control operations are performed for the two separate areas. However, the present invention is not limited to this. For example, smaller separate areas may be set or the boundary portion for area determination may be shifted upward or downward from the middle of a page. That is, if the above determination flag is ON, and information of the central position 2102 at which the non-print area 2101 is present is received, printing may be performed in accordance with the processing in steps S1207 to S1210 up to the central position based on the flag and the information, and then printing may be performed in accordance with the processing in steps S1211 to S1214 after the central position based on the flag and the information. The processing can be performed in accordance with the number of the non-print areas 2101 in one page.

As described above, according to the second embodiment, it is checked whether a plurality of image areas are to be separately printed within one page, and printing can be performed at optimal driving frequencies set for the respective separate image areas.

This operation allows fine control in changing the driving frequency, and hence can suppress a decrease in throughput while maintaining high image quality as compared with the case where driving frequencies are switched on one page basis.

Figure 24:
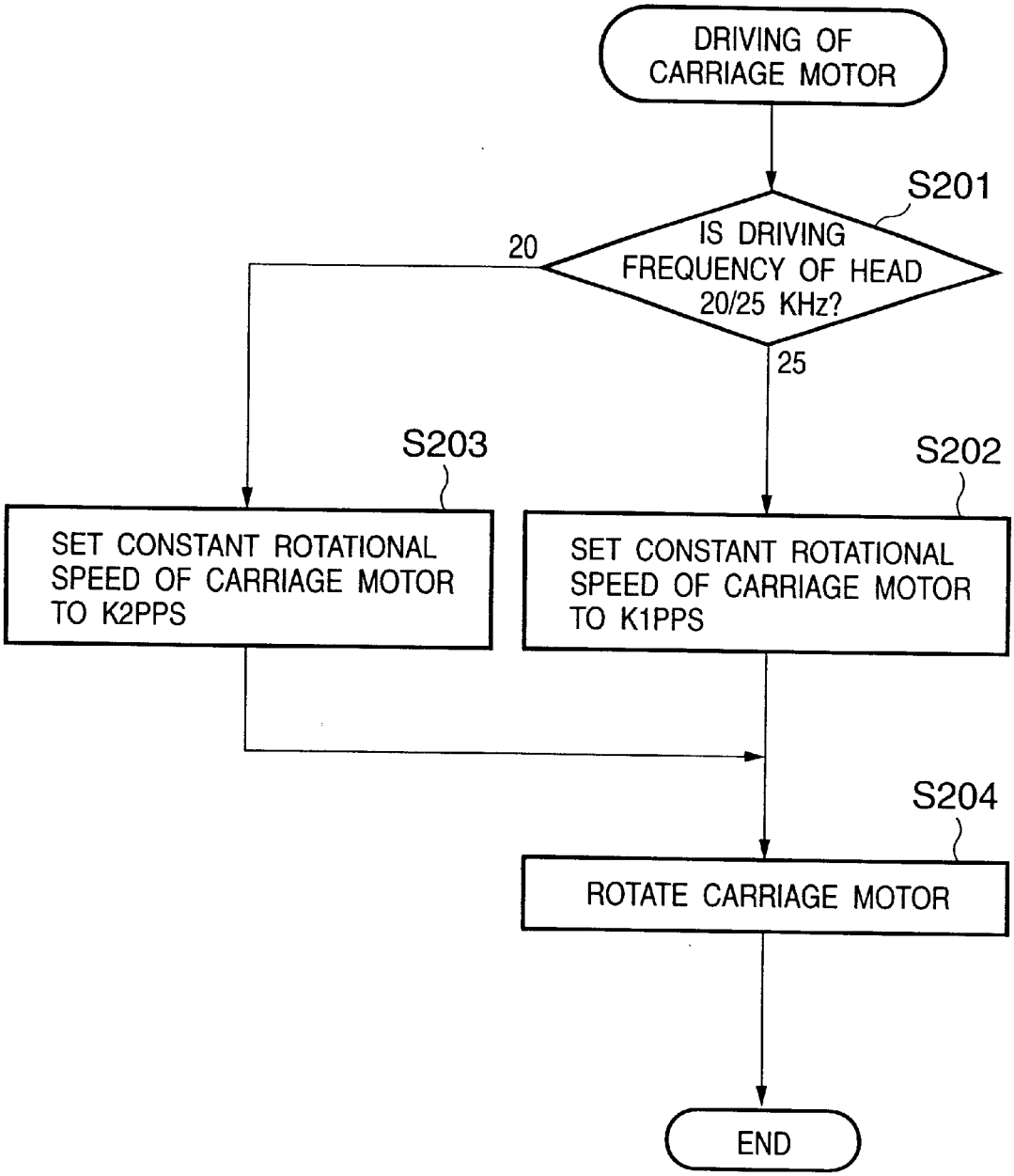
FIG. 24 is a flow chart showing control on the driving operation of a carriage motor in the first and second embodiments.

FIG. 24 is a flow chart showing a procedure for controlling the rotation of a carriage motor 20001 for controlling the traveling of a carriage 14001 in accordance with a change of the driving frequency of the printhead 11001 in the driving frequency determination unit 202.

In step S201, it is checked whether the driving frequency of the printhead 31001 is changed to 20 or 25 KHz. If the driving frequency is changed to 25 KHz, the flow advances to step S202 to set the constant rotational speed of the carriage motor 20001, i.e., the constant traveling speed of the carriage 14001, to K1 [pps]. If the driving frequency of the printhead 31001 is changed to 20 KHz, the flow advances to step S203 to set the constant rotational speed of the carriage motor 20001, i.e., the constant traveling speed of the carriage 14001, to K2 [pps]. In this case, K1>K2. The flow then advances to step S204 to rotate the carriage motor 20001 at the rotational speed set in step S202 or S203 to make the carriage 14001 travel. In synchronism with this scanning operation, the ink-jet printhead 31001 is driven in accordance with image data to eject ink, thereby printing an image.

In the first embodiment described above, the driving frequency is changed in units of pages, on which images are separately printed, to prevent a change in an image printed on one page, due to a change in driving frequency, from appearing on the page.

In the second embodiment, the driving frequency is changed in units of print area separated by a blank area within one page. This makes it possible to make a change in an image due to a change in driving frequency less conspicuous.

In addition, driving frequencies may be switched in units of lines that include no blank lines. In this case, the difference between printed images on adjacent lines due to a change in driving frequency becomes more conspicuous than that in the preceding embodiments. However, since the driving frequency is not changed in the process of printing an image of one line, no image unevenness occurs due to a change in driving frequency within the line.

The present invention described above has exemplified a printer, which comprises means (e.g., an electrothermal transducer, laser beam generator, and the like) for generating heat energy as energy utilized upon execution of ink discharge, and causes a change in state of ink by the heat energy, among the ink-jet printers. According to this ink-jet printer and printing method, a high-density, high-resolution printing operation can be attained.

As the typical arrangement and principle of the ink-jet printing system, one practiced by use of the basic principle disclosed in, for example, U.S. Pat. Nos. 4,723,129 and 4,740,796 is preferable. In this system, at least one pulse driving signal corresponding to print information is applied to an electrothermal transducer placed in correspondence with a liquid channel to generate heat energy to effect film boiling on a heat acting surface. By discharging the liquid (ink) through an orifice upon growth of this bubble, at least one droplet is formed.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printing head, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which has a heat acting portion arranged in a flexed region is also included in the present invention.

In addition, not only an exchangeable chip type printing head, as described in the above embodiments which can be electrically connected to the apparatus main unit and can receive ink from the apparatus main unit upon being mounted on the apparatus main unit but also a cartridge type printing head in which an ink tank is integrally arranged on the printing head itself can be applicable to the present invention.

It is preferable to add recovery means for the printing head, preliminary auxiliary means, and the like provided as an arrangement of the printer of the present invention since the printing operation can be further stabilized. Examples of such means include, for the printhead, capping means, cleaning means, pressurization or suction means, and preheating means using electrothermal transducers, another heating element, or a combination thereof. It is also effective for stable printing to provide a pre-discharge mode which performs discharge independently of printing.

In addition to the print mode of printing images only in a main color such as black, the printer may have at least one of the print mode of printing images in different colors and the print mode of printing images in full-color as a mixture of colors, which mode may be realized by an integral printhead or a combination of a plurality of printheads.

The present invention may be applied to a system constituted by a plurality of devices (e.g., a host computer, an interface device, a reader, a printer, and the like) or an apparatus comprising a single device (e.g., a copying machine, a facsimile apparatus, or the like).

The object of the present invention is realized even by supplying a storage medium storing software program codes for realizing the functions of the above-described embodiments to a system or apparatus, and causing the computer (or a CPU or an MPU) of the system or apparatus to read out and execute the program codes stored in the storage medium. In this case, the program codes read out from the storage medium realize the functions of the above-described embodiments by themselves, and the storage medium storing the program codes constitutes the present invention. The functions of the above-described embodiments are realized not only when the readout program codes are executed by the computer but also when the OS (Operating System) running on the computer performs part or all of actual processing on the basis of the instructions of the program codes.

The functions of the above-described embodiments are also realized when the program codes read out from the storage medium are written in the memory of a function expansion card inserted into the computer or a function expansion unit connected to the computer, and the CPU of the function expansion card or function expansion unit performs part or all of actual processing on the basis of the instructions of the program codes.

As has been described above, each embodiment described above can prevent a deterioration in image quality due to a deterioration in ink refill characteristics with a rise in head temperature, and minimize a decrease in printing speed.

In addition, the driving frequency of the printhead is not changed within an image print area, but is changed only when image areas are separated as in the case where the driving frequency is changed in units of pages or independent image areas. This makes it possible to prevent the generation of defective images such as an image with a disturbance due to a change in head driving frequency and an image with streaks.

The present invention is not limited to the above embodiments and various modifications can be made within the spirit and scope of the present invention. Therefore, to apprise the public of the scope of the present invention, the following claims are made.

What is claimed is:

1. An ink-jet printing apparatus for printing an image based on image information on a printing medium while effecting relative movement between an ink-jet printhead and the printing medium, comprising:

temperature acquisition means for acquiring a temperature of the ink-jet printhead and outputting temperature information;

driving means for driving the ink-jet printhead in various driving frequencies, based on the image information; and control means for changing the driving frequency in a case where the image information of at least one line in a page does not exist, in accordance with a comparison result of the temperature information outputted by said temperature acquisition means and a predetermined temperature, and causing said driving means to drive the ink-jet printhead at the changed driving frequency.

2. The apparatus according to claim 1, wherein said temperature acquisition means acquires the temperature information in predetermined units of image information.

3. The apparatus according to claim 1, wherein said control means changes the driving frequency in a case where the image information does not exist between separated image areas within one page.

4. The apparatus according to claim 1, wherein said control means changes the driving frequencies before and after the at least one line in which the image information does not exist.

5. The apparatus according to claim 4, wherein the at least one line corresponds to a print width of the printhead and on which no printing is performed.

6. The apparatus according to claim 1, wherein the predetermined temperature (Tth) and an upper limit temperature (TLMT) at which a deterioration in image occurs in printing have a relationship represented by $Tth \leqq TLMT - \Delta T$, where $\Delta T$ is a possible change amount of temperature rise in printing at a current driving frequency.

7. The apparatus according to claim 1, wherein said control means also performs control to change a scanning speed of the ink-jet printhead in accordance with a change in the driving frequency of the ink-jet printhead.

8. The apparatus according to claim 1, wherein said control means lowers the driving frequency of the ink-jet printhead in a case where the temperature information indicates a temperature higher than the predetermined temperature.

9. An ink-jet printing method for an ink-jet printing apparatus for printing an image based on image information on a printing medium while effecting relative movement between an ink-jet printhead and the printing medium, comprising the steps of:

acquiring a temperature of the ink-jet printhead;

controlling to change a driving frequency of the ink-jet printhead in a case where the image information of at least one line in a page does not exist, in accordance with a comparison result of temperature information acquired in said acquiring step and a predetermined temperature; and driving the ink-jet printhead at the driving frequency changed in said controlling step.

10. The method according to claim 9, wherein in said acquiring step, the temperature is acquired in predetermined units of image information.

11. The method according to claim 9, wherein the driving frequency is changed between separated image areas within one page in said controlling step.

12. The method according to claim 9, wherein the driving frequencies are changed before and after the at least one line in which the image information does not exist.

13. The method according to claim 12, wherein the at least one line corresponds to a print width of the printhead and on which no printing is performed.

14. The method according to claim 9, wherein the predetermined temperature (Tth) and an upper limit temperature (TLMT) at which a deterioration in image occurs in printing have a relationship represented by $Tth \leqq TLMT - \Delta T$, where $\Delta T$ is a possible change amount of temperature rise in printing at a current driving frequency.

15. The method according to claim 9, wherein in said controlling step, a scanning speed of the ink-jet printhead is changed in accordance with a change in the driving frequency of the ink-jet printhead.

16. A computer-readable storage medium storing a program for executing the ink-jet printing method defined in claim 9.

17. The method according to claim 9, wherein in said controlling step, the driving frequency of the ink-jet printhead is lowered in a case where the temperature information indicates a temperature higher than the predetermined temperature.

* * * * *